US010556137B2

(12) United States Patent
Rose

(10) Patent No.: US 10,556,137 B2
(45) Date of Patent: Feb. 11, 2020

(54) LEG STRAP ASSEMBLY FOR A BACKPACK WITH AN INFLATABLE AIRBAG

(71) Applicant: Amer Sports Canada Inc., North Vancouver (CA)

(72) Inventor: Gordon T. Rose, Bowen Island (CA)

(73) Assignee: Amer Sports Canada Inc., North Vancouver, B.C. (CA)

( * ) Notice: Subject to any disclaimer, the term of this patent is extended or adjusted under 35 U.S.C. 154(b) by 0 days.

(21) Appl. No.: 14/860,219

(22) Filed: Sep. 21, 2015

(65) Prior Publication Data

US 2016/0016044 A1 Jan. 21, 2016

Related U.S. Application Data

(63) Continuation-in-part of application No. 14/802,475, filed on Jul. 17, 2015, now Pat. No. 9,427,625.
(Continued)

(51) Int. Cl.

| | |
|---|---|
| ***B63C 9/08*** | (2006.01) |
| ***A62B 33/00*** | (2006.01) |
| ***A45F 3/04*** | (2006.01) |
| ***A45F 4/02*** | (2006.01) |
| *A45F 3/00* | (2006.01) |

(52) U.S. Cl.
CPC ..... *A62B 33/00* (2013.01); *A45F 3/04* (2013.01); *A45F 4/02* (2013.01); *B63C 9/08* (2013.01); *A45F 2003/008* (2013.01); *A45F 2003/045* (2013.01)

(58) Field of Classification Search
CPC .. B63C 9/00; B63C 9/11; B63C 9/125; B63C 9/18; B63C 9/155; B63C 2009/00; B63C 2009/0023; B63C 2009/0029; B63C 2009/007; B63C 2009/0076; B63C 2009/0082; A41D 13/0002; A63B 29/021;
(Continued)

(56) References Cited

U.S. PATENT DOCUMENTS

| | | | |
|---|---|---|---|
| 3,710,409 | A | 1/1973 | Davidson |
| 3,768,467 | A | 10/1973 | Jennings |

(Continued)

FOREIGN PATENT DOCUMENTS

| | | |
|---|---|---|
| EP | 1992241 | 11/2008 |
| EP | 1948323 B1 | 4/2011 |

(Continued)

*Primary Examiner* — Daniel V Venne
(74) *Attorney, Agent, or Firm* — Terence P. O'Brien

(57) ABSTRACT

A backpack for carrying by a user includes a body, an inflatable balloon, a balloon inflation system, a balloon inflation system coupled to the body and to the inflatable balloon, an actuator operably coupled to the balloon inflation system, and a leg strap assembly. The body includes a support element and at least a first enclosure. The inflatable balloon is positioned within the enclosure. The leg strap assembly includes a leg strap fastener, a first leg strap having a first end coupled to the support element and a second end coupled to the leg strap fastener, and a second leg strap end having a first end coupled to the body and a second end releasably connectable to the leg strap fastener. The support element is coupled to the balloon such that, upon inflation of the balloon, tensile force is applied to the support element and to the leg strap assembly.

18 Claims, 20 Drawing Sheets

Related U.S. Application Data

(60) Provisional application No. 62/026,251, filed on Jul. 18, 2014.

(58) Field of Classification Search
CPC ... A62B 33/00; A45F 3/04; A45F 4/02; A45F 2003/045; A45F 2003/008
USPC ..... 441/80, 88, 89, 90, 92, 106, 114; 2/455
See application file for complete search history.

(56) References Cited

U.S. PATENT DOCUMENTS

| | | | | |
|---|---|---|---|---|
| 4,008,983 | A | 2/1977 | Flatt et al. | |
| 4,031,674 | A | 6/1977 | Rand | |
| 4,246,672 | A | 1/1981 | Fujiyama et al. | |
| 4,521,166 | A | 6/1985 | Phillips | |
| 4,523,914 | A * | 6/1985 | Faulconer | B63C 11/08 441/106 |
| 4,635,754 | A | 1/1987 | Aschauer et al. | |
| 4,671,744 | A | 6/1987 | Shaffer et al. | |
| 4,836,426 | A | 6/1989 | Munn et al. | |
| 4,920,674 | A | 5/1990 | Shaeffer | |
| 4,943,252 | A | 7/1990 | Manix | |
| 5,293,707 | A | 3/1994 | Shaeffer | |
| 5,599,041 | A | 2/1997 | Turnbull et al. | |
| 6,158,380 | A | 12/2000 | Aschauer et al. | |
| 6,220,909 | B1 | 4/2001 | Aschauer et al. | |
| 6,298,487 | B1 | 10/2001 | Mayhew | |
| 6,676,467 | B1 | 1/2004 | Filsouf | |
| 7,264,525 | B2 | 9/2007 | Tsitas | |
| 7,270,077 | B2 | 9/2007 | Beck | |
| 7,445,235 | B2 | 11/2008 | Makabe et al. | |
| 8,123,581 | B2 | 2/2012 | Aschauer | |
| 8,494,480 | B2 | 7/2013 | Aschauer et al. | |
| 8,777,684 | B2 | 7/2014 | Grutta et al. | |
| 8,851,948 | B2 | 10/2014 | Grutta et al. | |
| 8,851,949 | B2 | 10/2014 | Grutta et al. | |
| 8,876,568 | B2 | 11/2014 | Blenkarn et al. | |
| 9,004,116 | B2 | 4/2015 | Walker et al. | |
| 9,272,187 | B2 | 3/2016 | Blenkarn et al. | |
| 2001/0049840 | A1 | 12/2001 | Atanasio | |
| 2003/0146348 | A1 | 8/2003 | Douglas et al. | |
| 2004/0157514 | A1 * | 8/2004 | Courtney | B63C 9/20 441/88 |
| 2006/0107952 | A1 | 5/2006 | Schlosser | |
| 2007/0157925 | A1 | 7/2007 | ShterenBerg | |
| 2008/0041906 | A1 | 2/2008 | Rose et al. | |
| 2008/0257643 | A1 | 10/2008 | Weinel et al. | |
| 2008/0282453 | A1 | 11/2008 | Alstin et al. | |
| 2009/0239428 | A1 * | 9/2009 | Berchten | A62B 33/00 441/80 |
| 2010/0006176 | A1 | 1/2010 | Pansegrouw | |
| 2010/0087112 | A1 | 4/2010 | Chou | |
| 2010/0112880 | A1 | 5/2010 | Aschauer | |
| 2010/0184343 | A1 | 7/2010 | Paynton et al. | |
| 2010/0255809 | A1 | 10/2010 | Aschauer et al. | |
| 2013/0019994 | A1 | 1/2013 | Schaer et al. | |
| 2013/0145528 | A1 | 6/2013 | Grutta et al. | |
| 2013/0145529 | A1 * | 6/2013 | Grutta | A62B 33/00 2/455 |
| 2013/0146175 | A1 | 6/2013 | Walker et al. | |
| 2013/0149923 | A1 | 6/2013 | Walker et al. | |
| 2013/0149924 | A1 | 6/2013 | Grutta et al. | |
| 2013/0283510 | A1 * | 10/2013 | Berchten | A62B 33/00 2/455 |

FOREIGN PATENT DOCUMENTS

| | | |
|---|---|---|
| GB | 1590604 | 6/1981 |
| JP | 20041211794 | 4/2004 |
| JP | 2006123736 | 5/2006 |
| WO | 2010085576 | 7/2010 |

* cited by examiner

LEG STRAP ASSEMBLY FOR A BACKPACK WITH AN INFLATABLE AIRBAG

RELATED U.S. APPLICATION DATA

This present application is a continuation-in-part of U.S. patent application Ser. No. 14/802,475 filed on Jul. 17, 2015 (now U.S. Pat. No. 9,427,625), which claims the benefit under 35 U.S.C. § 119(e) of U.S. Provisional Patent Application No. 62/026,251, filed Jul. 18, 2014, the disclosure of which is hereby incorporated by reference thereto in its entirety. The present application is related to co-pending U.S. patent application Ser. No. 14/860,126, filed on the same day herewith and entitled IMPROVED ENCLOSURE RELEASE FOR A BACKPACK WITH AN INFLATABLE AIRBAG, the full disclosure of which are hereby incorporated by reference.

FIELD OF THE INVENTION

The present invention relates generally to an outdoor backpack including an inflatable balloon or air bag. In particular, the present invention relates to an avalanche backpack including an improved enclosure release for an inflatable balloon, and an improved leg strap.

BACKGROUND

Airbag rescue or safety systems are known in the industry are employed as a life-saving system to enable a person using such system to survive an avalanche, or analogous situation. Such systems, when activated, help to maintain the user or the user's equipment buoyant during an avalanche, or analogous situation, and to maintain the user or equipment on the surface of the avalanche, or as close to the surface as possible, thereby enabling the user to survive the avalanche or to facilitate recovery of the user's equipment. The airbag system can be incorporated a backpack or a vest, and can include an inflatable air bag packed within the backpack or vest, a balloon inflation system and an activation mechanism. The air bag safety systems help to keep a user on the surface of the snow by a combination of inverse segregation particle sorting and buoyancy, whereby less dense particles in a medium tend to float to the surface. Inverse segregation particle sorting refers to the mechanism by which larger particles in a moving medium (e.g., snow) tend to stay at the top of the medium.

The balloon inflation system may include a battery-powered electric motor or a canister of compressed air or gas to inflate the bag. Such systems typically include a large airbag having a volume of over 1000 liters that is inflated by releasing compressed gas or by using an air movement device, such as an air blower, a fan, an air pump or an air compressor. Airbag rescue systems can create significant lifting forces during use that should be transferred to the user in an effective and efficient manner. Without proper transfer of such lifting forces, the airbag backpack may become separated from the user, or may potentially harm the user by riding up on the user's torso upon actuation or use. Some airbag rescue systems also include one or two leg straps.

Such backpacks or vests are typically formed of a flexible textile material and typically retain the air bag in a flexible enclosure with a zippered opening. Upon actuation of such systems, the airbag can begin to inflate within the enclosure and typically exerts pressure upon the flexible enclosure is generally uniform fashion. The distributed forces or pressure exerted upon the enclosure of the backpack from the inflating airbag may not be sufficient to cause the zippered opening of the backpack enclosure to open, thereby preventing proper release and deployment of the airbag. Although airbag rescue systems that utilize air movement devices such as air blowers, fans, air pumps and air compressors, offer many advantages over pressurized gas canister systems, such air movement devices can be susceptible to insufficient force or pressure to release the balloon or bladder from the backpack. Pressurized gas canister inflation systems can also be susceptible to a failure of the airbag or balloon to release from its enclosure.

Additionally, rescue systems with one or more leg straps typically have one end of the leg strap that is looped for receiving a waist belt or band of the pack, vest or harness, and for attaching the leg strap to the waist belt. Accordingly, in order to properly secure the leg strap, a user must use both hands to thread the waist band through the looped end of the leg strap before connecting the waist belt buckle. The leg strap of such systems cannot be undone independently without having to also undo the waist belt. This manipulation required for use of the leg strap can be cumbersome, time-consuming and difficult to complete for packs filled with gear. The manipulation of the looped end of the leg strap through the waist belt also makes it very difficult for a user to easily move the rescue pack to the side of his or her body for accessing gear or for use on ski lifts. Still further, many existing airbag safety systems that incorporate a leg strap do not provide an adjustable length strap that renders the airbag safety system susceptible to riding up on the user's torso. The inconvenience and improper fitting of such leg straps results in many users failing to use the leg strap altogether, which significantly increases the risk of the airbag safety system separating from the user during use or injuring the user by riding up onto the user's torso during use. Additionally, many existing airbag safety systems do not position the leg strap in an efficient load bearing position and therefore do not properly transfer or distribute the loads resulting from actuation and use of the airbag safety system to the user.

What is needed is an airbag safety or rescue system that overcomes such drawbacks. There is a continuing need for an airbag safety or rescue system that allows for efficient, reliable, and repeatable release and deployment of an inflatable balloon or bladder upon actuation. There is also a continuing need for an improved leg strap system that is easy to use and facilitates proper distribution of loads to the user and the airbag system during use or activation. What is needed is an air bag rescue system that is easy to wear, use and properly transfers lifting forces provided by the airbag safety system to the user and inhibits the system from being pulled up and/or off of the user. It would be advantageous to provide an airbag safety system that works reliably, is easy to use and can be worn comfortably by the user.

SUMMARY

The invention relates to an airbag system and, more particularly, to an airbag rescue or safety system and, more particularly, an airbag system employed as a life-saving system to enable a person using such system to survive an avalanche, or analogous situation, such as to facilitate a water rescue, e.g., as well as an airbag system for attachment to, and for recovering, equipment of the person, such as a snowmobile. In these regards, the invention relates to such systems disclosed in U.S. Pat. No. 8,876,568, the disclosure of which is hereby incorporated by reference thereto in its entirety. The system can employ a battery-powered electric motor to turn the blower, i.e., the fan, turbine, or impeller, e.g., to inflate the airbag. In another implementation of the invention, an airbag rescue or safety system can rely upon a compressed gas or air cartridge to inflate the airbag.

More particularly, the present invention relates to a backpack that includes a body including at least a first enclosure defining at least a first compartment and a first opening for accessing the first compartment, an inflatable balloon positioned within first compartment, a zipper, a balloon inflation system and an actuator. The first enclosure includes at least a first restricting element. The zipper includes first and second fastener tapes. Each of the first and second fastener tapes is attached to the first enclosure at the first opening. The zipper is positionable between an open position, in which the fastener tapes are substantially separated from each other, and a closed position, in which the first and second fastener tapes are engaged to each other along an engagement line. The zipper includes at least a first targeted zipper separation location. The first restricting element is positioned in alignment with the first zipper separation location. The balloon inflation system is coupled to the body and the inflatable balloon. The actuator is operably coupled to the balloon inflation system, such that upon actuation of the balloon inflation system with the zipper in the closed position, the first restricting element concentrates a zipper separation force in a direction generally perpendicular to the engagement line to separate the first and second fastener tapes of the zipper at the first targeted zipper location. The zipper separation force is formed by the inflating balloon engaging the first enclosure.

According to a principal aspect of one implementation of the invention, a backpack for carrying by a user includes a body, an inflatable balloon, a balloon inflation system coupled to the body and to the inflatable balloon, an actuator operably coupled to the balloon inflation system, and a leg strap assembly. The body includes a support element and at least a first enclosure defining at least a first compartment and a first opening for accessing the first compartment. The inflatable balloon is positioned within the first compartment. The leg strap assembly includes a leg strap fastener, a first leg strap having a first end coupled to the support element and a second end coupled to the leg strap fastener, and a second leg strap end having a first end coupled to the body and a second end releasably connectable to the leg strap fastener. The support element is coupled to the inflatable balloon such that upon inflation of the balloon, tensile force is applied to the support element and to the leg strap assembly.

According to another principal aspect of one implementation of the invention, a backpack for carrying by a user includes a body, an inflatable balloon, a balloon inflation system coupled to the body and to the inflatable balloon, a waist belt, a waist belt mount, and a leg strap assembly. The body includes a support element and at least a first enclosure defining at least a first compartment and a first opening for accessing the first compartment. The inflatable balloon is positioned within the first compartment. The balloon inflation system is coupled to the body and to the inflatable balloon. The waist belt extends from a lower region of the body and including a waist belt fastener. The waist belt mount is coupled to the waist belt and positioned adjacent to the left or right hip of the user. The leg strap assembly includes a leg strap fastener, a first leg strap having a first end coupled to the support element and a second end coupled to the leg strap fastener, and a second leg strap end having a first end coupled to the body and a second end releasably connectable to the leg strap fastener.

This invention will become more fully understood from the following detailed description, taken in conjunction with the accompanying drawings described herein below, and wherein like reference numerals refer to like parts.

DETAILED DESCRIPTION

Figure 1:
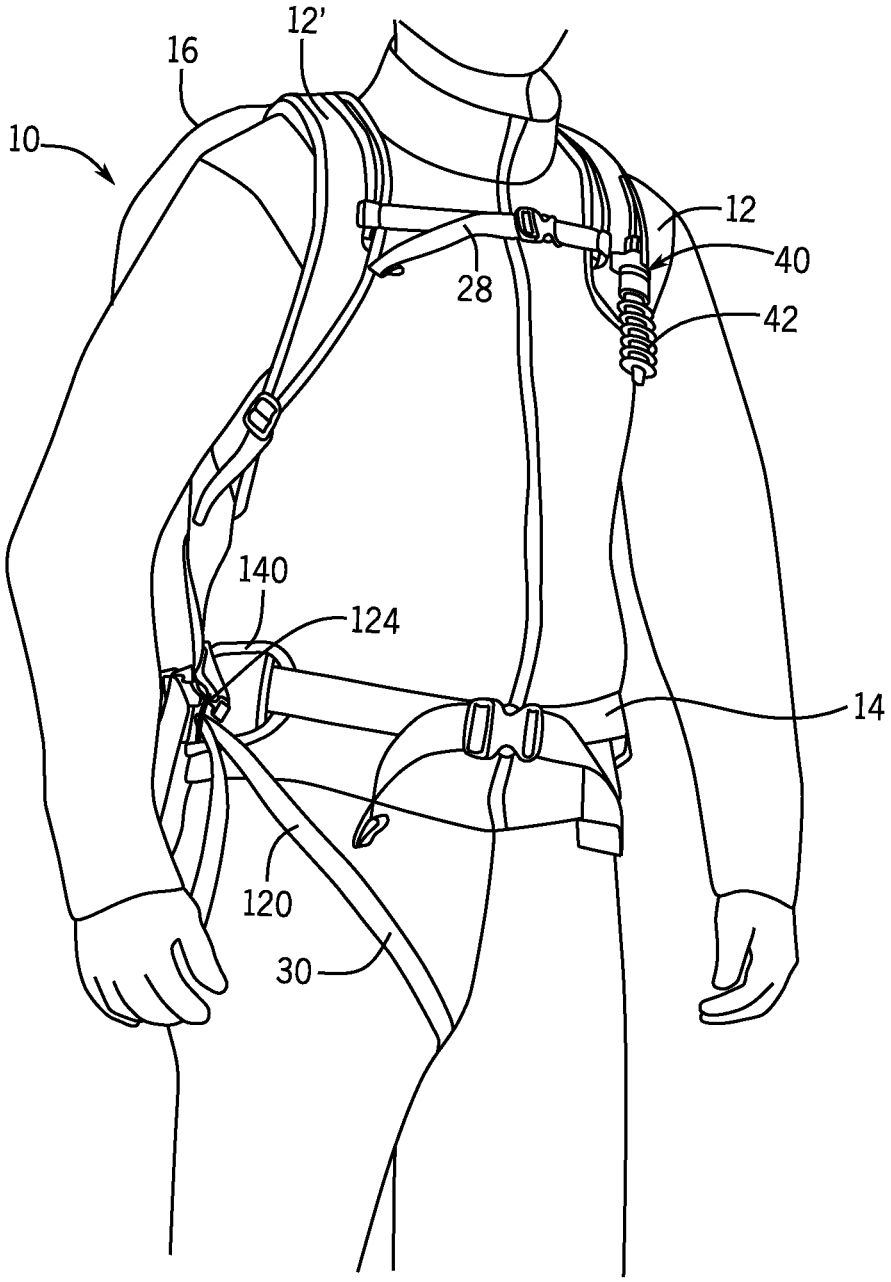
FIG. 1 is a front perspective view of an airbag rescue system according to one implementation of the present invention in the form of a pack being worn by a user and in a ready position with the airbag being stowed, non-deployed, within a compartment of the pack.
Figure 2:
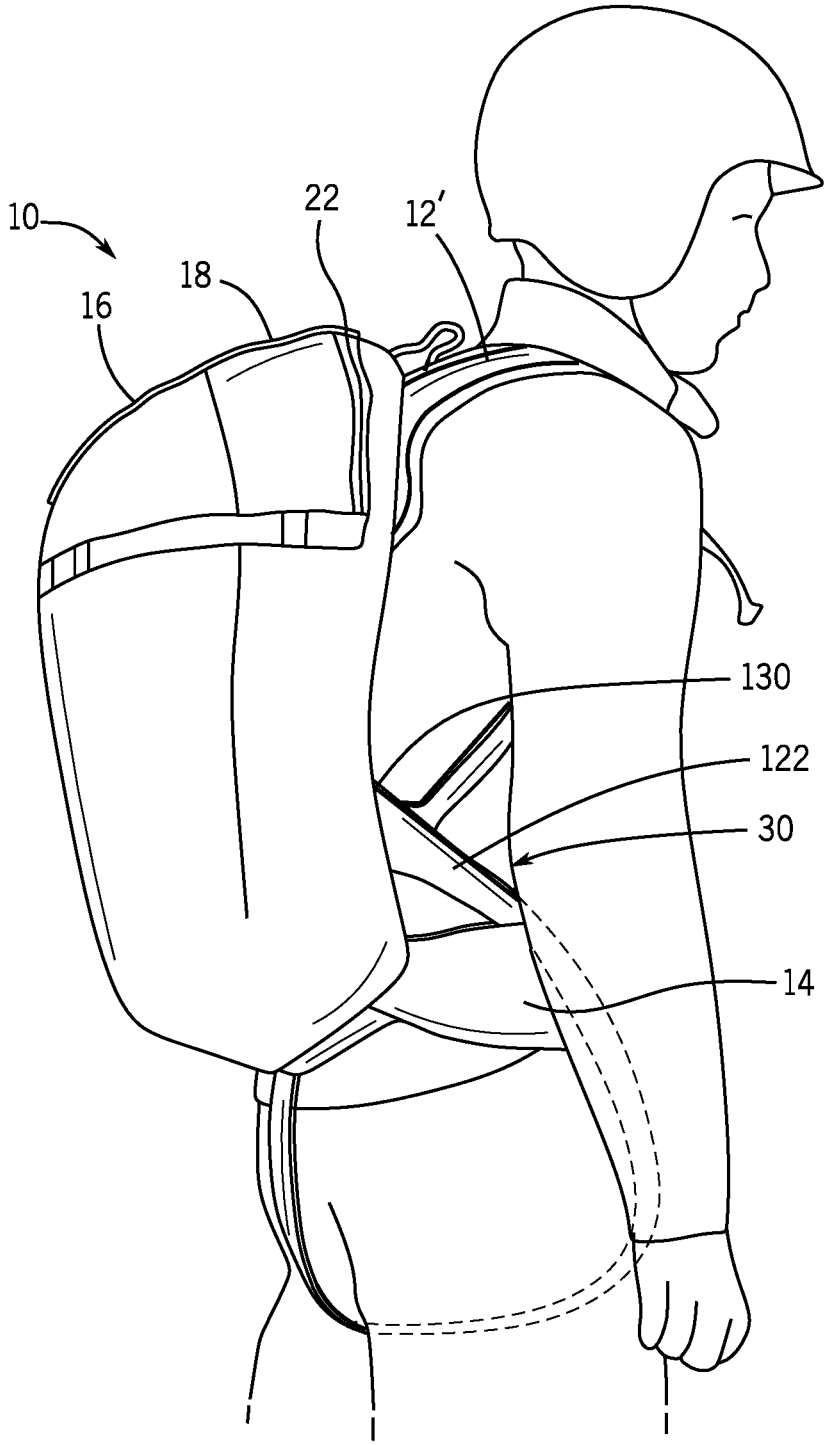
FIG. 2 is a side view of the rescue system pack of FIG. 1.
Figure 3:
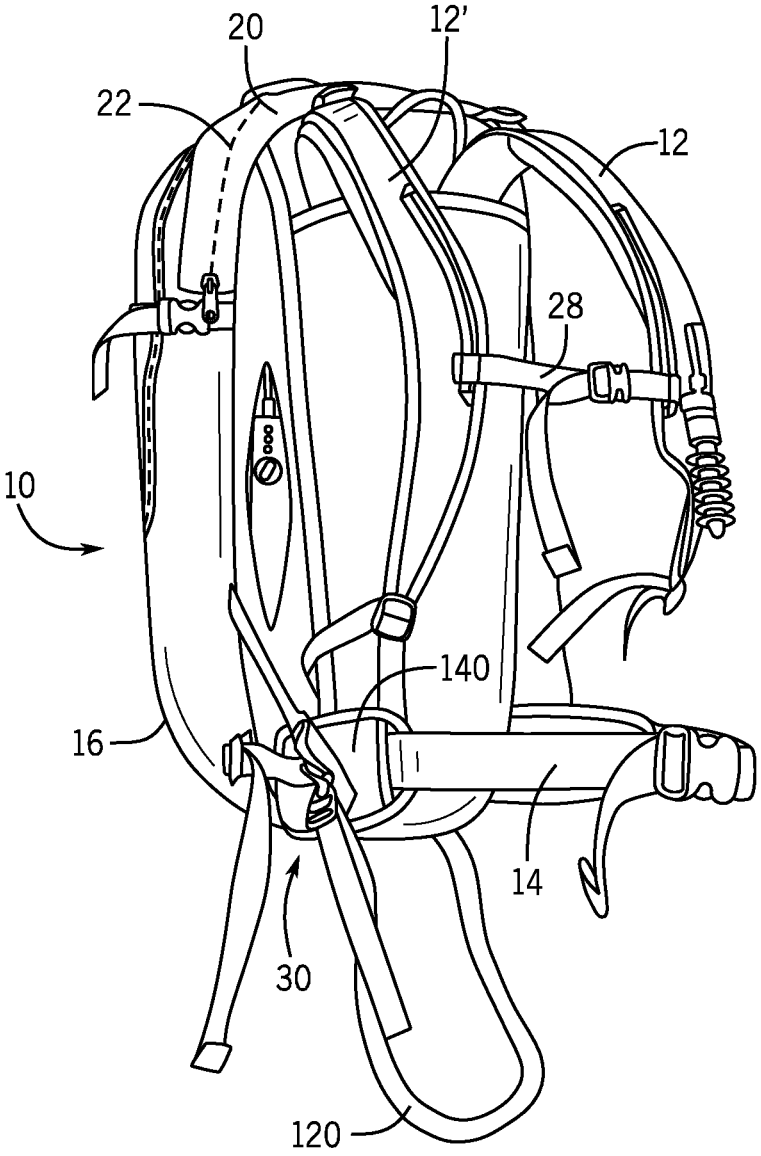
FIG. 3 is a front side perspective view of the rescue system pack of FIG. 1 removed from the user with the airbag in a stowed, non-deployed position.

The invention encompasses an efficient, reliable and repeatable airbag or balloon deployment system, such as for use in an avalanche rescue system, and, more particularly, in a system that employs a backpack, harness or vest that carries an inflatable airbag or balloon. The rescue system includes a triggering device designed to initiate the activation of a balloon inflation system to inflate the airbag or balloon, such as an electric motor that turns a fan/turbine/impeller or that activates inflation via a compressed gas or air canister/cartridge/container.

FIGS. 1 through 4 illustrate a backpack 10 worn on the back of a user in an undeployed or stowed position. Although the present figures illustrate the invention incorporated into a backpack, the invention is directly applicable for use with a harness or a vest, and such applications are contemplated under the present invention. The pack 10 is supported by at least one shoulder strap 12, or a pair of shoulder straps 12, 12' and a waist band 14 extending from a body 16. The body 16 is a storage and support structure formed of a lightweight, durable material. In one implementation, the body 16 is formed of a tough, flexible material, such as a woven or unwoven textile material. In other implementations, the body can be formed of rigid materials or combinations of rigid and flexible materials. The body 16 includes at least one enclosure 18 defining at least a first compartment 20 having a first opening 22. The first opening 22 is reclosably closed by a first zipper 38 or one or more other fasteners. In one implementation, the body 16 includes multiple compartments 24 for storing equipment, gear, food, fluids, battery, airbags, motors, gas canisters, and other goods. In one implementation, the first compartment 20 is used to retain an airbag 26 (see FIGS. 12A and 12B), or balloon or bladder, in an uninflated state. The backpack 10 can further include a chest strap 28 and a leg strap assembly 30 for securing the pack 10 to the user.

Figure 4:
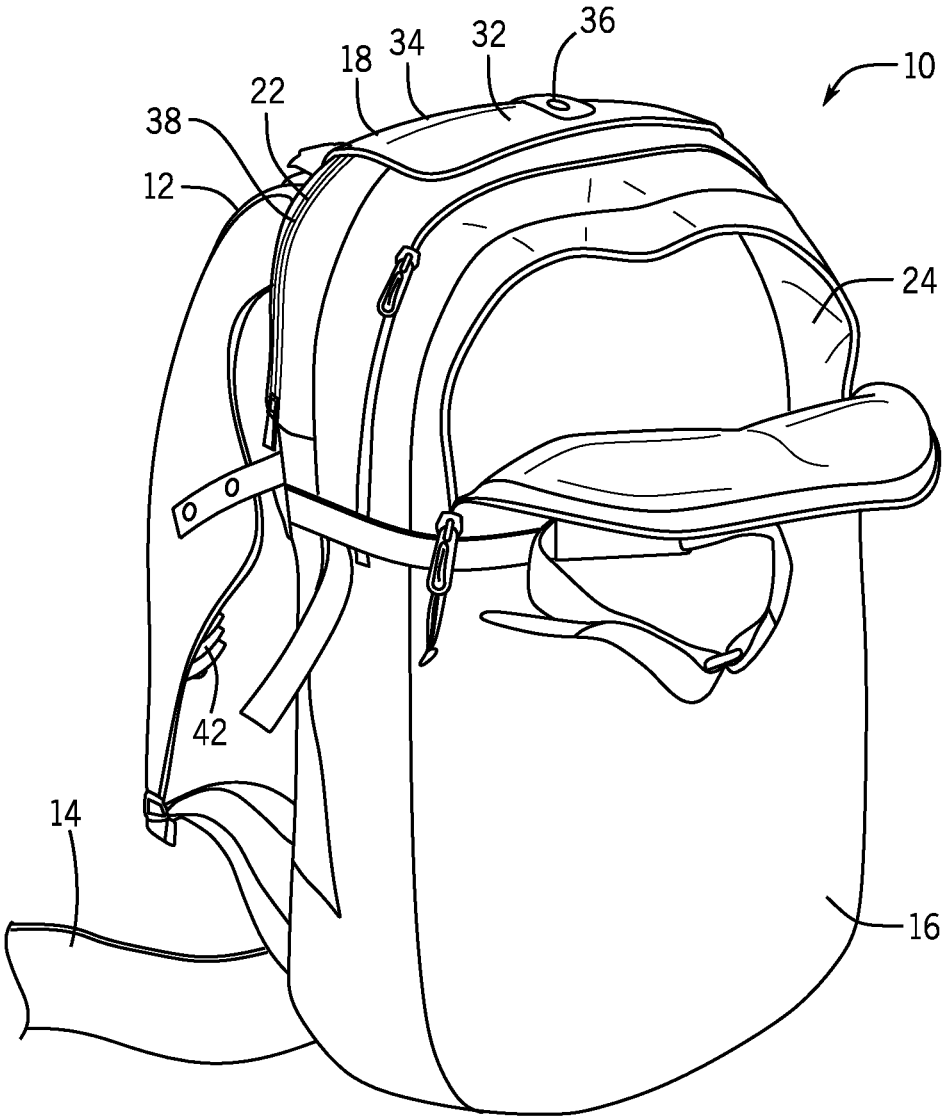
FIG. 4 is a rear side perspective view of the rescue system pack of FIG. 3.
Figure 5:
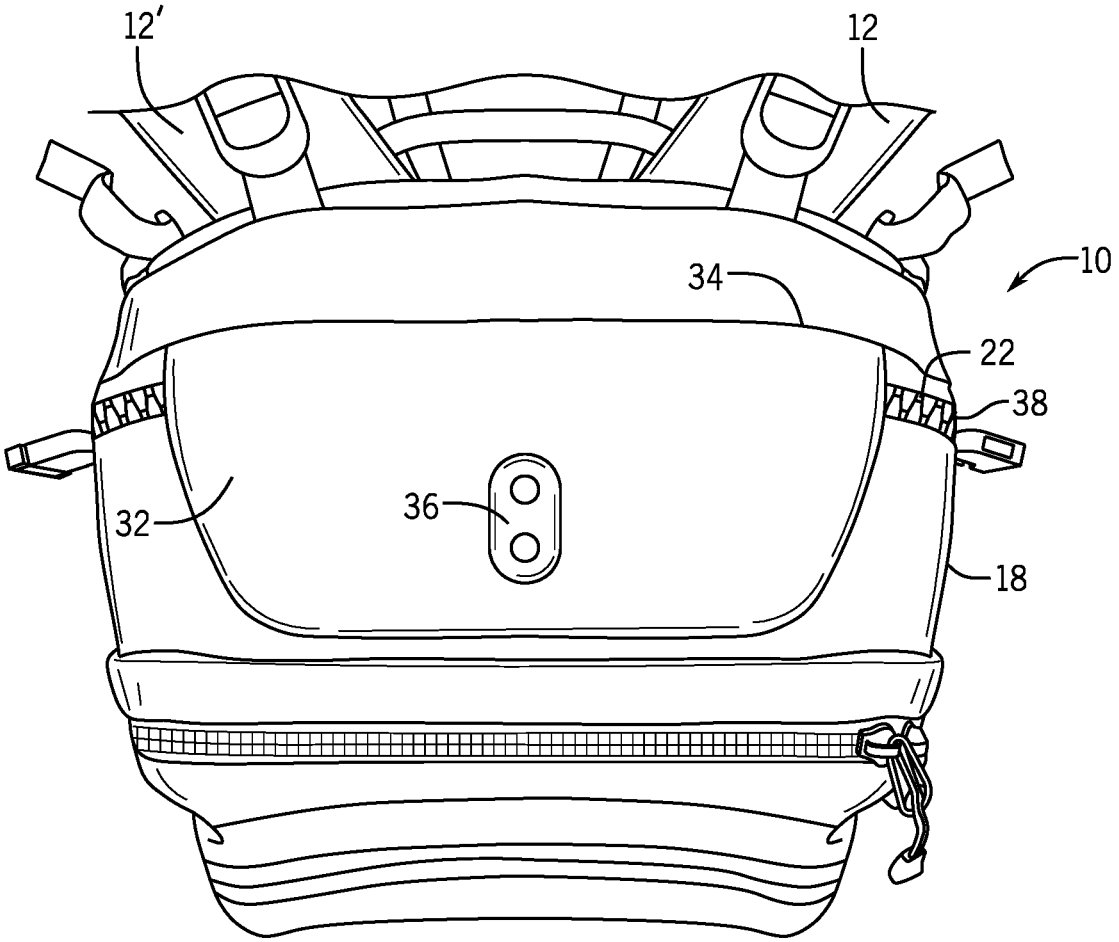
FIG. 5 is a top view of the rescue system pack of FIG. 3.

Referring to FIGS. 4 and 5, the top of the pack 10 includes a hinged flap 32, shown in a closed position beneath which an uninflated or underinflated airbag 26 housed within the first compartment 20 of the pack 1. In one implementation, the flap 32 is hinged to the pack 10 by a stitched seam 34, and is releasably secured to the top of the pack 10 through a releasable latch 36. In other implementations, the flap can be fastened to the top of the pack through other fastening mechanisms. The flap 32 is a generally flexible panel sized to extend over a central region of the first zipper 38 of the first compartment 20 of the enclosure 18. The first zipper 38, described in greater detail below, is configured to open and close the first compartment 20 and to retain the uninflated airbag 26 within the compartment 20. The first zipper 38 is also configured to readily open when the airbag 26 is inflated. The flap 32 provides a secondary retention mechanism for ensuring that the first compartment 20 of the enclosure 18 remains closed when the pack 10 is in an uninflated state or position. The flap 32 also inhibits the introduction of moisture, snow and/or debris from entering the first compartment 20 through the first zipper 38. In another implementation, the flap can be removed from the pack.

Referring to FIGS. 1 and 5 through 7, the pack 10 includes actuation assembly 40 for releasing the latch 36 and actuating the inflation of the airbag 26. The actuation assembly 40 includes an actuator 42 (or triggering device), a cable 44 in a housing 46, a latch mechanism 48, and an electrical switch 50. When the user actuates the actuator 42, the latch mechanism 48 is moved to a position that allows the stowed airbag 26 to emerge from within the pack as it is inflated.

The actuator 42 is designed to be easily accessible to the user, and to be difficult to trigger accidentally. In one implementation, the actuator 42 is constantly available on, or just off, a shoulder strap and not, for example, in a closed pocket, perhaps zipped away. FIG. 1 shows the actuator 42 conveniently located at a generally mid-torso height, or slightly above the mid-torso, and at a left-of-center position on or proximate the left shoulder strap 12, the latter location being particularly convenient for grasping the handle with the right hand. For left-handed grasping of the actuator 42, the actuator 42 can be releasably fixed in placed so that it can be relocated on or proximate the right shoulder strap 12'.

Accidental triggering of the actuator is prevented by virtue of certain precautionary measures. A trigger lock can be incorporated into the actuator 42. In one implementation, the actuator 42 can include a slide trigger lock, similar to a gun safety, that can be readily moved by one's finger selectively between an engaged and locked position, and a disengaged and unlocked position. When the slide trigger lock is in the unlocked position, the width of the lock can be centered, or substantially centered, in relation to the length of the actuator 42. When the slide trigger lock is in a locked position, the width of the lock can be offset in relation to the length of the actuator 42.

In another implementation, the trigger lock can be a twistable trigger lock. The twistable lock is rotatable about a base that allows the user to flip the trigger lock 180 degrees, i.e., with the remainder of the handle or actuator, around the base between locked and unlocked positions, the latter position allowing the actuator 42 to be pulled longitudinally to initiate airbag inflation. That is, for accomplishing airbag inflation, the user moves the actuator 42 according to two manipulations. First, the safety lock must be rotated from the locked position to the unlocked position. Second, the actuator 42 must be pulled to release the post 52 from the latch member 54 and actuating the electrical switch 50 to initiate airbag inflation.

A particular feature of the actuator 42 is that it is very easy for the user, that is, the person wearing the avalanche airbag and pack, to locate and grab the actuator. To this end, the actuator or handle is always externally accessible, in contrast to systems whose components are stowed in a pouch, such as a zippered pouch, on a shoulder strap to prevent an accidental release that might be caused by being caught/snagged on something or an ill-timed or accidental manipulation. For systems in which the handle is kept in a pouch, the user can forget to unzip the handle and have it accessible when it is taken out. Also, they tend to move around within the pouch, so the handle is not in the same position all the time.

The cable 44 or, more particularly, the cable 44 in a housing 46, extends from the actuator 42 to the latch mechanism 48 and electrical switch 50 that activates inflation of the airbag. Another measure that can be used to prevent accidental triggering is a requirement for a certain threshold force to be exerted for triggering the activation of the inflation of the airbag. For example, a pull force within a range of 50 N to 150 N, for example, can be set to release the airbag, i.e., a good firm pull. This range is in the proposed CE standard (such as in the February 2014 draft Norm prEN 16716 "Mountaineering equipment—Avalanche airbag systems—Safety requirements and test methods)." For example, a force of 100 N can be set.

In the unlocked position, the actuation assembly 40 can include one or more detents and corresponding recesses. The detents become frictionally engaged with the actuator 42 when the actuator 42 is pulled in a direction to trigger airbag inflation. The detent(s) and recess(es) can be structured and made of materials, such as one or more elastically deformable materials or shapes, so as to require the aforementioned force of 50-150 N to be exerted by pulling on the actuator 42, passing over the detents and recesses. The detents provide physical feedback to the user. The required force 50-150 N could be settable and/or designed differently, for instance, by using elastic means, a spring, rubber, or the like. The total pull travel of the actuator 42 can be approximately 45 to 50 mm, thereby providing a user with an opportunity to stop pulling in the event of an unintentional triggering attempt. In other implementations, the required force can be outside of the 50-150 N range.

The latch mechanism 48 can be used in implementations incorporating an electrically powered inflation embodiment, the triggering of the power switch 50, that activates an airbag or balloon inflation system 60 (see FIG. 13), as described below. In other implementations, the latch mechanism 48 and the electrical switch 50 can be used to release a pressurized gas canister 62 (see FIG. 15). The latch mechanism 48 and electrical switch 50 can be positioned in a housing having upper and lower portions 66 and 68.

When a completed pull of the actuator 42 or trigger handle is accomplished, a locking post 52 of the latch 36 fixed to the flap 32 at the top of the pack 1 is released from engagement with a latch hook member 54 that includes a latch hook 56 and a ramp 58. As the cable 44 is pulled, the latch hook 56 is pulled away from post 52, the ramp 58 bears against the post 52, and pushes the post 52 upward and out of engagement with the latch hook member 54. As latch hook member 54 is pulled out of engagement with the post 52, a projection 70 extending from the latch hook 56 engages the electrical switch 50 to initiate the airbag or balloon inflation system 60.

In one implementation, after the projection 70 engages the electrical switch 50, a motor is powered on to inflate the airbag 26, such as for a seven-second blower activation. The motor cannot be activated until the post 52 has been released from the latch hook member 54 thereby allowing the flap 32 to be released and be free to move out and away from the first opening 22 and the first zipper 38.

Referring to FIGS. 7 through 10, the opening of the first zipper 38 and the first opening 22 upon actuation of the balloon inflation system 60 is shown in greater detail. The airbag 26 is configured to begin to inflate upon actuation of the balloon inflation system 60. The deflated airbag 26 can be stowed in folded manner within the first compartment 20 (such as by "origami" style or any non-restricting fold(s)), which allows the airbag to inflate, during inflation, in all directions. As described in the background, one drawback of airbag inflation systems with flexible containment structures is that as the airbag inflates, it generally exerts equal pressure (and equalizes the forces) within the compartment and distributes the pressure throughout the compartment. Generally, the amount of pressure required to open a flexible containment structure containing an inflatable airbag can be significantly greater than the pressure required to inflate the airbag. Accordingly, if the airbag is not configured to provide an initiation site for opening of the opening containing the airbag, the distributed pressure exerted throughout the compartment may be insufficient to open the compartment, thereby causing failure of the airbag to release from its enclosure into a deployed state.

The present invention overcomes this drawback by providing at least one restricting element 72 on the first enclosure 18 of the backpack 10 adjacent the recloseable opening 22 and the first zipper 38 retaining the airbag 26. The at least one restricting element 72 helps to concentrate zipper separation forces formed by the inflating airbag 26 or balloon in a direction that is generally perpendicular to an engagement line of the first zipper 38. In other words, the restricting element 72 introduces a pressure riser or an increase area of force at the desired location along the zipper as the inflating airbag 26 exerts pressure on the first enclosure 18.

Figure 9:
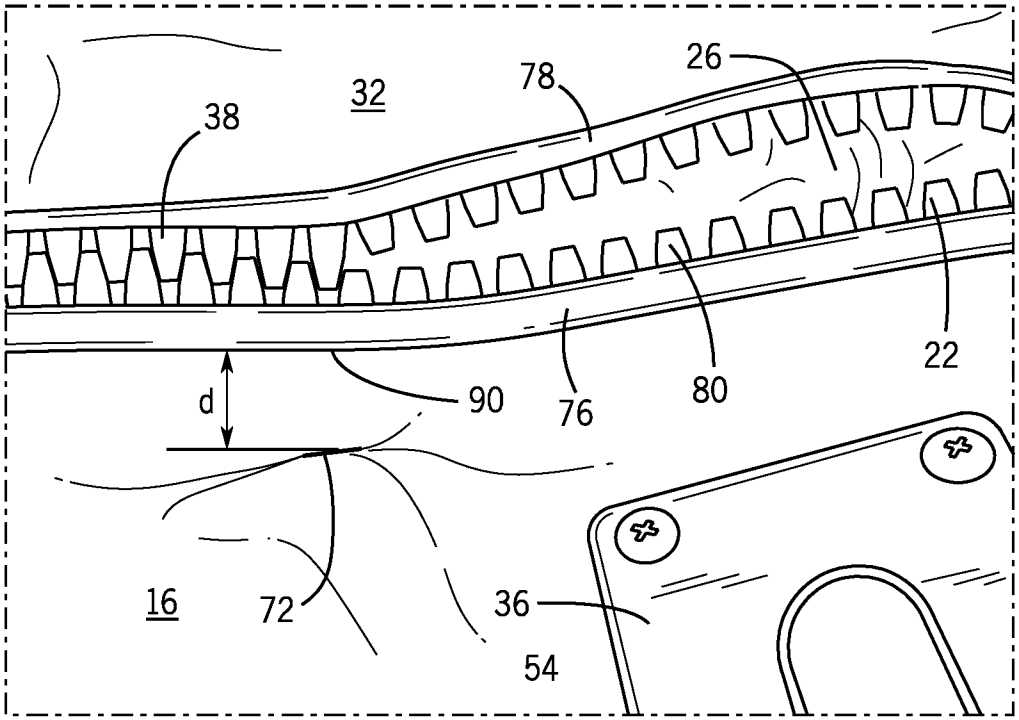
FIG. 9 is an enlarged top view of the rescue system pack of FIG. 3 illustrating the separation of a zipper and the initial release of a balloon.

In one implementation, the at least one restricting element 72 is a stitching or a sewn dart formed adjacent to a first zipper separation location 90 along the first zipper 38. The first zipper separation location 90 is a location in the zipper 38 where separation of the first zipper 38 for release of the airbag 26 or balloon is initiated or initially propagated. In one implementation, the restricting element 72 is positioned adjacent a first zipper separation location 90 along the first zipper 38, and is spaced apart from the first zipper 38 by a distance, d (FIG. 9). In one implementation, the distance d is less than 5 cm from the first zipper 38. In another implementation, the distance d is 2 cm or less from the first zipper 38.

Figure 10:
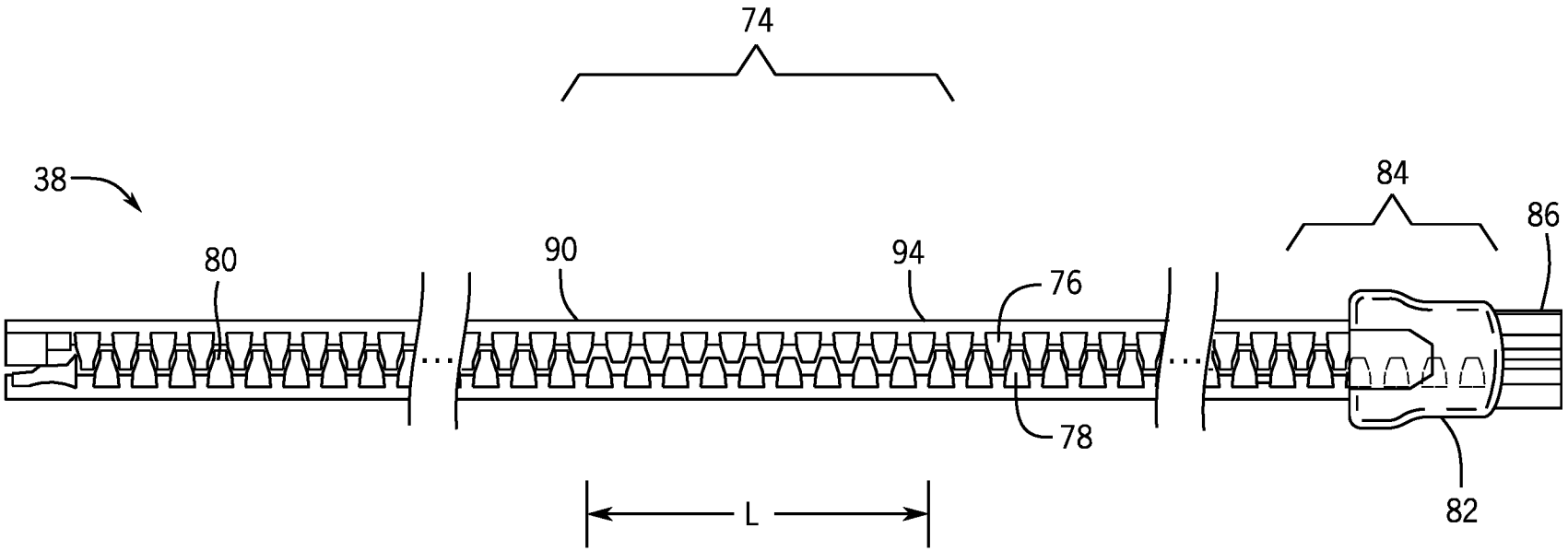
FIG. 10 is a top view of a zipper for an airbag enclosure of a rescue pack of FIG. 1.

In one implementation, the first zipper 38 can be configured with a burst region 74. The first zipper 38 includes first and second fastener tapes 76 and 78, each including a plurality of teeth 80. The teeth 80 are configured to releasably engage and disengage each other when acted upon by a slider 82 (FIG. 10). The teeth 80 when engaged extend along a zipper engagement line that follows the longitudinal dimension of the zipper 38. It is understood that since the zipper 38 is flexible, the engagement line can be curved or straight. The burst region 74 is a portion of the zipper 38 in which the teeth 80 of the first and/or second fastener tapes 76 and 78 have been removed or clipped such that the teeth do not fully engage each other in the burst region, regardless of the action or movement of the slider 82 along the zipper 38. When the first zipper 38 is in a closed condition, the teeth 80 at the burst region 74 are not fully engaged. As a result, the burst region 74 provides a location of reduced resistance to opening of the zipper 38 upon inflation of the airbag. In the closed position, the teeth 80 of the zipper 38 are substantially engaged, meaning that the non-trimmed or clipped teeth are engaged with each other and the clipped or trimmed teeth are in close proximity to each other in the burst region 74. As the airbag is inflating, the burst region 74 is configured to facilitate the opening of the first zipper 38 from the force generated by the inflating airbag, thereby allowing the airbag to emerge from the airbag compartment to the deployed position. In one implementation, the burst region 74 has a length (L) that is at least 3 cm. In another implementation, the burst region 74 has a length within the range of 7 to 9 cm. In other implementations, other lengths of the burst region 74 can be used. When the backpack 10 is in a non-deployed position with the airbag 26 stowed in the first compartment 20 and the first zipper 38 closed, the flap 32 extends over the burst region 74 and latches at the latch 36 to cover the burst region 74 to inhibit the introduction of moisture and/or debris into the first compartment 20 through the burst region 74 of the first zipper, and to provide a secondary mechanical closure to maintain the first zipper 38 in a closed position or state.

In another implementation, the zipper 38 further includes a slider release zone 84 positioned at an end stop 86 of the first zipper 38. The release zone 84 enables the slider 82 to separate from the second fastener tape 78 upon full opening of the first zipper 38 on inflation and release of the airbag 26. Without the release zone 84, the zipper 38 and/or slider 82 can be damaged due to the stress created by the inflation pressure of the deployed airbag 26. The release zone 84 enables the slider to separate from one of the first and second fastener tapes 76 and 78, and retain engagement with the other of the first and second fastener tapes 76 and 78. Once the airbag 26 is deflated following inflation and re-inserted within the first compartment 20 of the enclosure 18, the release zone 84 facilitates the reengagement of the slider 82 with the second fastener tape 78 as the slider 82 moves away from the end stop 86 to reclose the first zipper 38.

Figure 7:
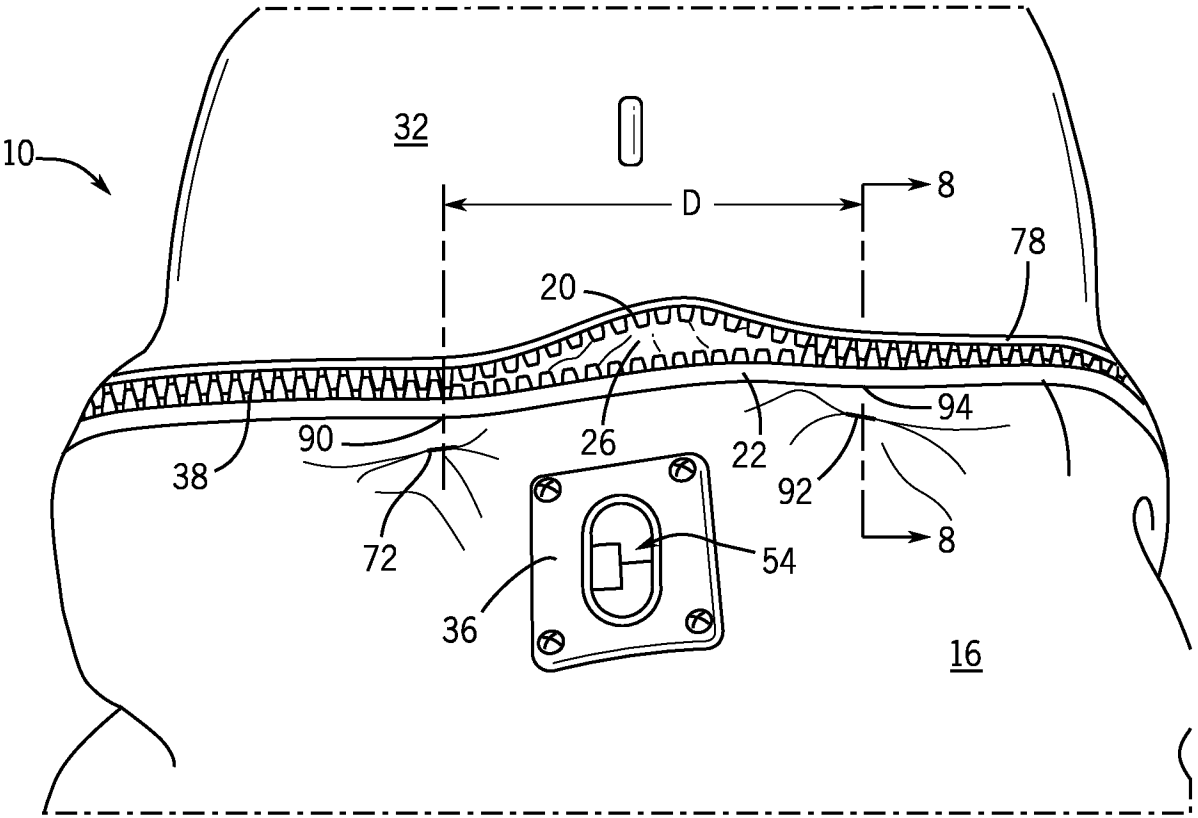
FIG. 7 is a top view of the rescue pack of FIG. 3 with the latch mechanism released and the flap shown in an open, unlatched position.
Figure 8:
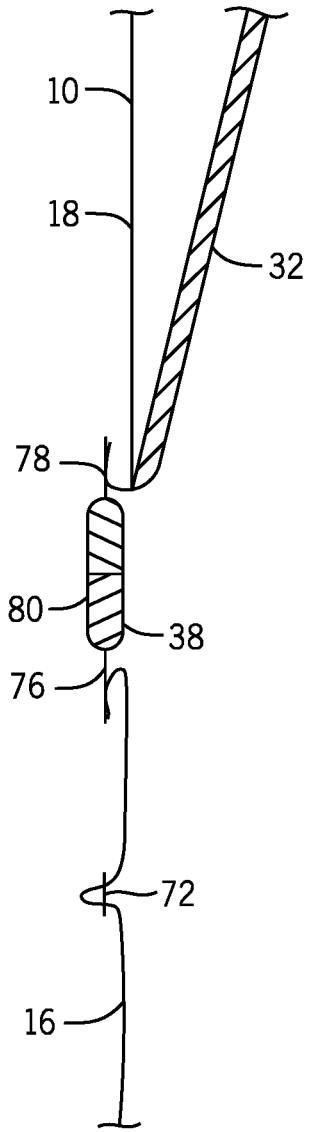
FIG. 8 is a cross-sectional view of the rescue pack taken along line 8-8 of FIG. 7.

Referring to FIG. 7, in one implementation, the at least a first restricting element 72 is first and second restricting elements 72 and 92 spaced part from each other by a distance, D. The distance D can be within the range of 1 to 20 cm. In one implementation, the distance D is substantially equal to the distance L. In one implementation, the first and second restricting elements 72 and 92 are aligned with and adjacent to first and second zipper separation locations 90 and 94, respectively. The second zipper separation location 94 being positioned along the first zipper 38. In this implementation, the first and second restricting elements 72 and 92 concentrate, direct or focus separation forces caused by the inflating airbag 26 at the first and second zipper separation locations 90 and 94, respectively. The first and second zipper separation locations 90 and 94 are advantageously positioned at the ends of the burst region 74 to optimize the focused opening of the zipper 38 at the separation zones 90 and 94 outward along the zipper.

Figure 11A:
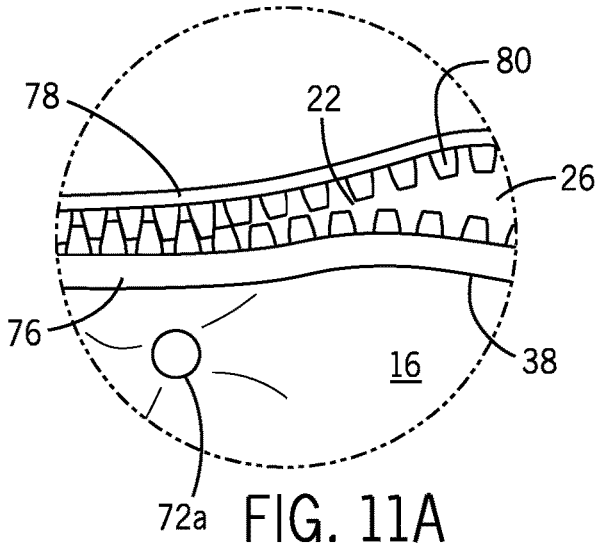
FIGS. 11A through 11D are enlarged top views of an upper portion of a rescue pack in accordance with other implementations of the present invention.
Figure 11B:
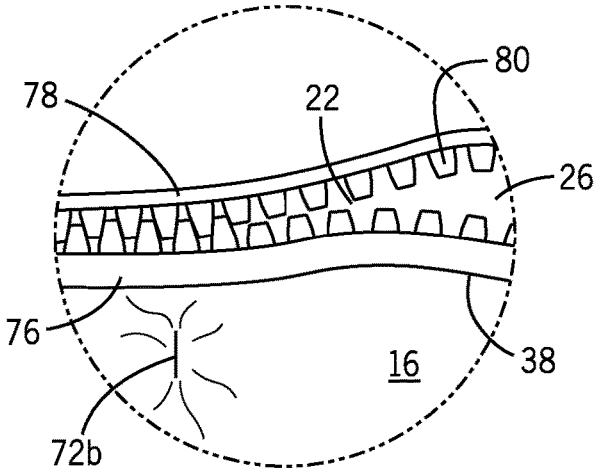
Figure 11C:
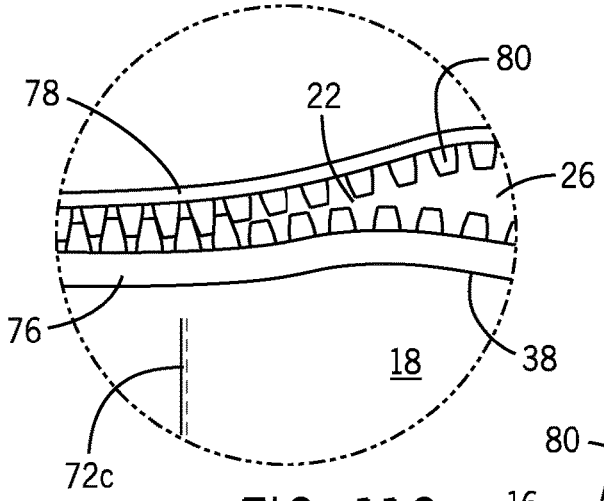
Figure 11D:
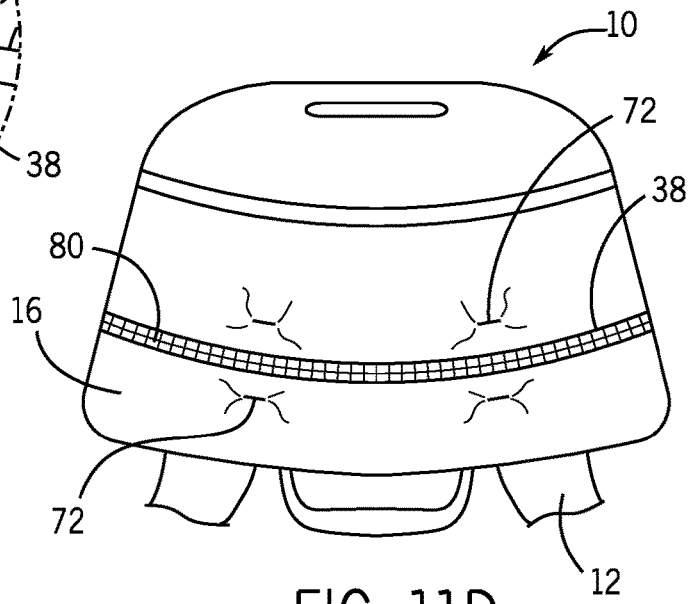

Referring to FIGS. 11A through 11C, the first and second restricting elements 72 and 92 can take other forms. In other implementations, the first and second restricting elements 72 and 92 can be: a rivet 72*a*; an adhesive fold or glued region 72*b*; the result of material patterning, such as a seam 72*c*; other forms of fasteners or restrictors; or combinations thereof. All such configurations of restricting elements are contemplated by the present invention. Referring to FIG. 11D, in one implementation, the at least a first restricting element 72 can be four separate spaced apart restricting elements 72 with two restricting elements 72 positioned on opposite sides of the first zipper 38. In other implementations, other numbers of restricting elements 72 and 92 can be used, such as, for example, 3, 5, 6 or more.

Figure 12A:
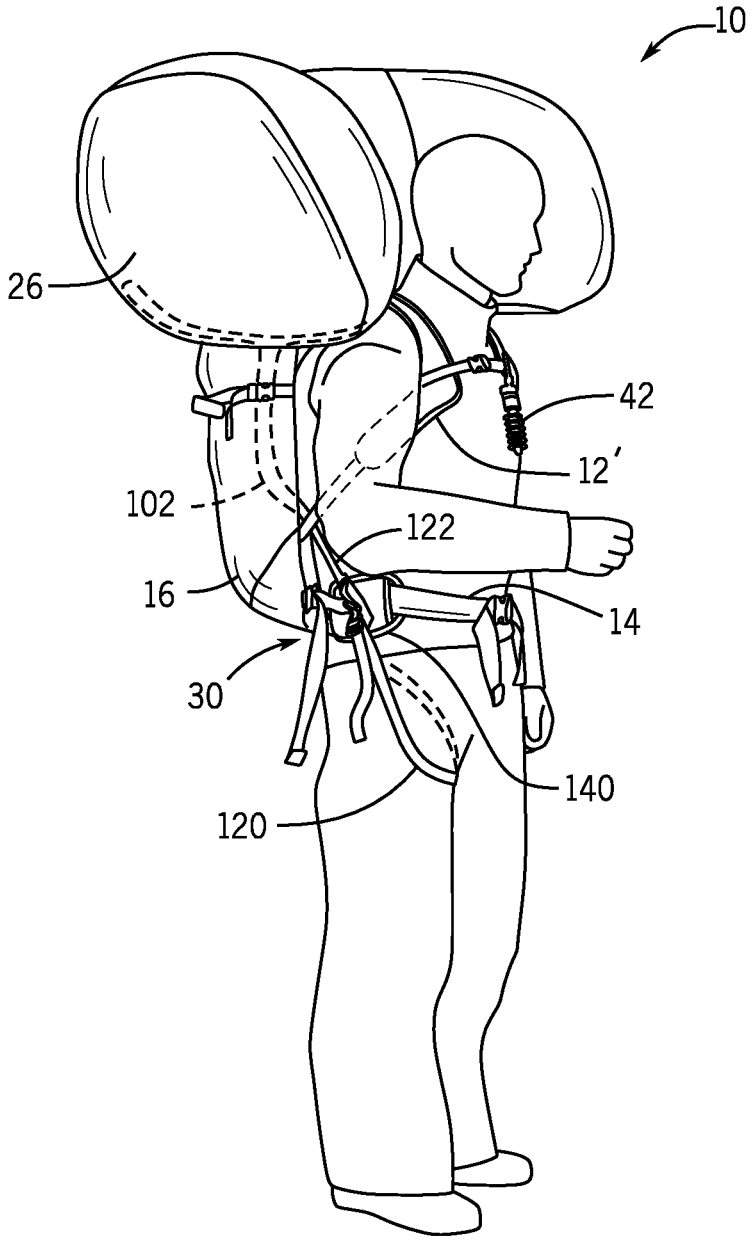
FIGS. 12A and 12B are side prospective views of the airbag rescue system of FIG. 1 shown with the airbag or balloon in a deployed position.
Figure 12B:
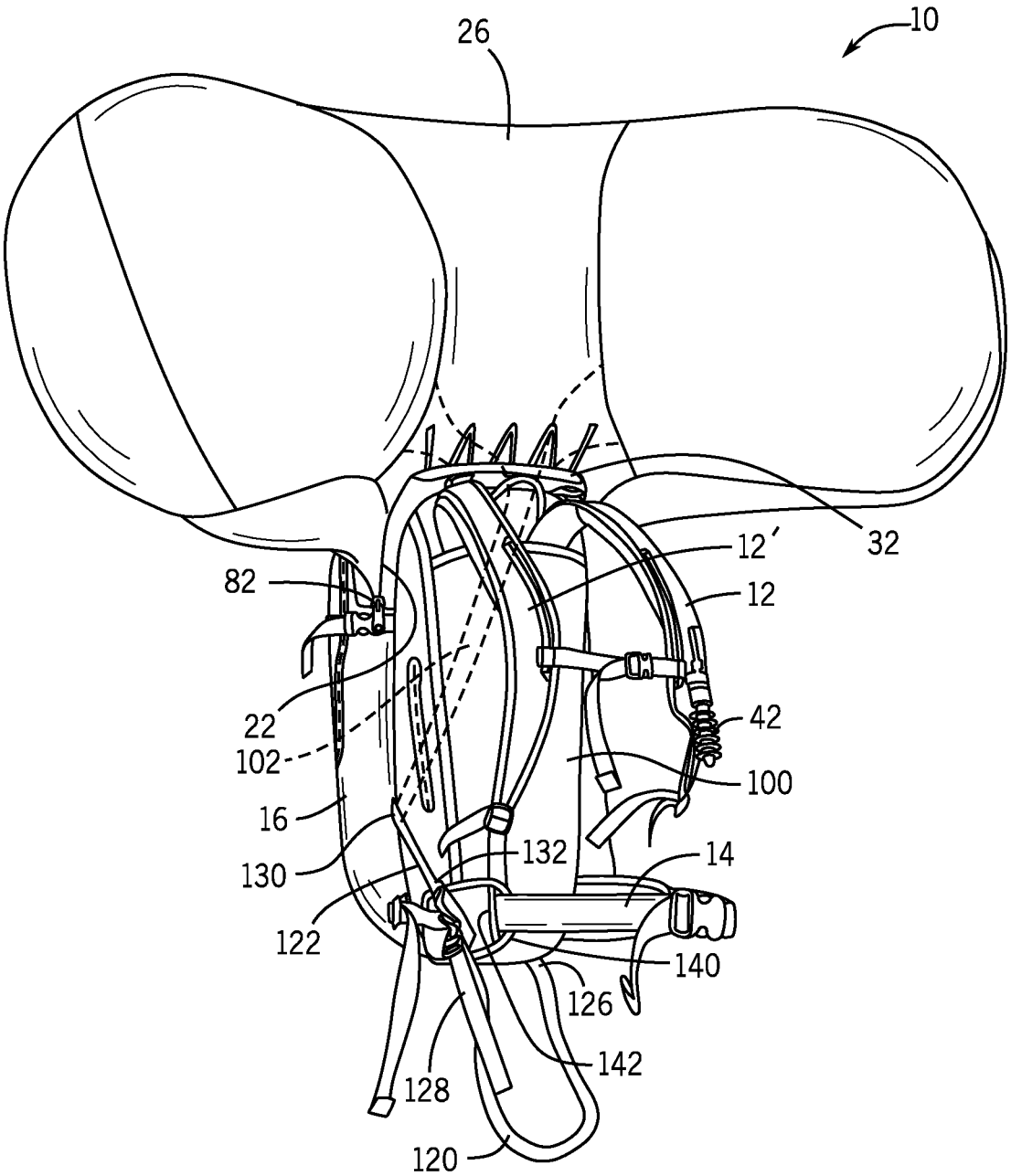

Referring to FIGS. 12A and 12B, the backpack 10 is illustrated with the airbag 26 or balloon in a deployed position. Although the airbag illustrated extends from the rear and along both sides of the head of the wearer, the invention is not limited to such particular shape and can be suitably practiced with other shapes. In addition, although a single airbag is shown, the invention can be suitably practiced with a pair of airbags, as disclosed, e.g., in U.S. Pat. No. 6,158,380 and other documents, or more than two airbags.

The backpack 10 further includes a back support structure 100 positioned within the body 16 of the backpack 10 adjacent the back of the user. In some implementations, the back support structure 100 can be used to support the user's back, one or more of the shoulder straps 12, the waist belt 14, the leg strap assembly 30, the balloon inflation system 60 and other handles, straps or elements. In one implementation, the back support structure 100 can be a planar structure with opening for connecting or coupling to other components or elements of the backpack 10. In other implementations, the back support structure 100 can be a curved structure, a frame, two or more spaced apart elements, two or more support webbings or other support structure. In one implementation, the leg strap assembly 30 can includes at least one support webbing 102, as part of the back support structure, that couples the airbag 26 to a strap of the leg strap assembly 30.

Figure 13:
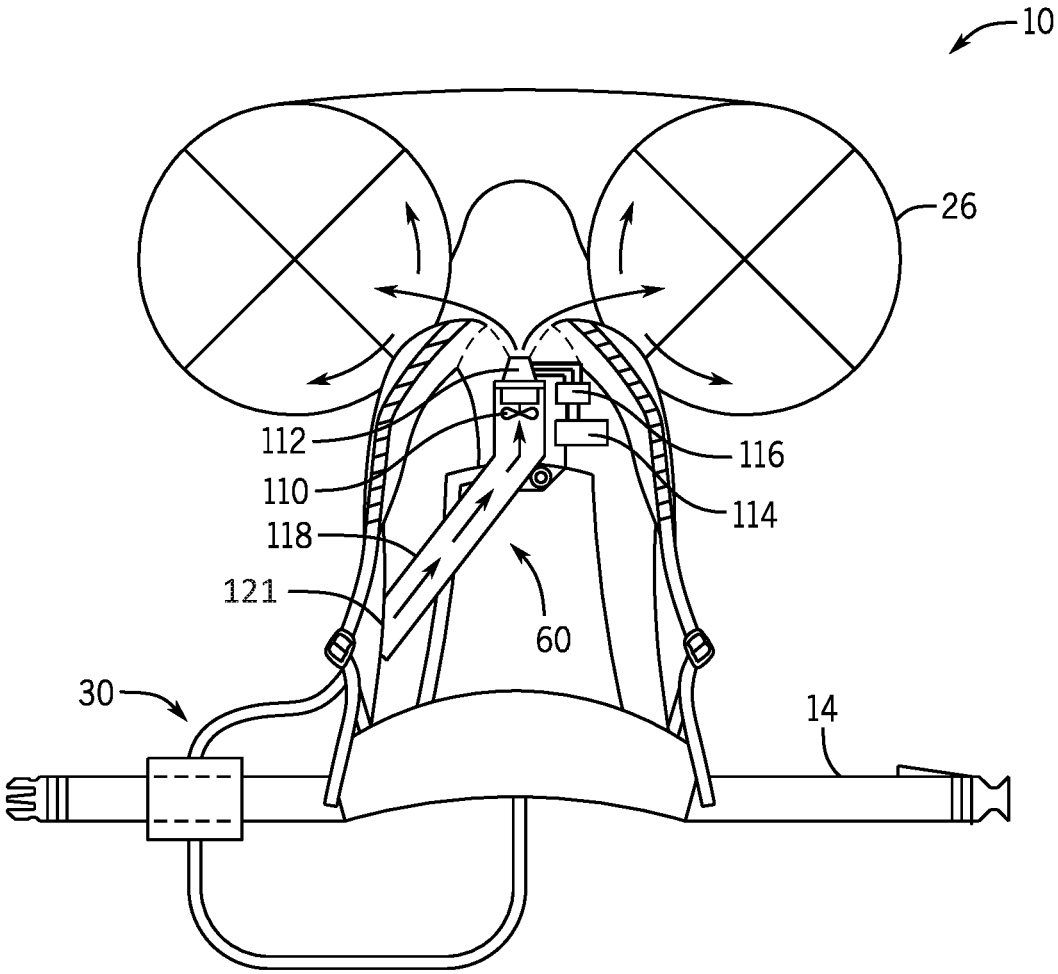
FIG. 13 is front view of the airbag rescue system of FIG. 12 illustrating air flow into the airbag.

Referring to FIG. 13, the backpack 10 includes the balloon inflation system 60. In one embodiment, as shown in FIG. 13, the balloon inflation system 60 includes an air movement device 110, an electric motor 112, a battery 114, a controller 116, the electrical switch 50, conduit 118 and one air intake screen or ventilated panel 121 to enable ambient air to be drawn into the pack 10. The intake screen 121 is positioned on the outer surface of the backpack 10. In one implementation, the intake screen 121 is on the left or right side of the enclosure 18.

Figure 14:
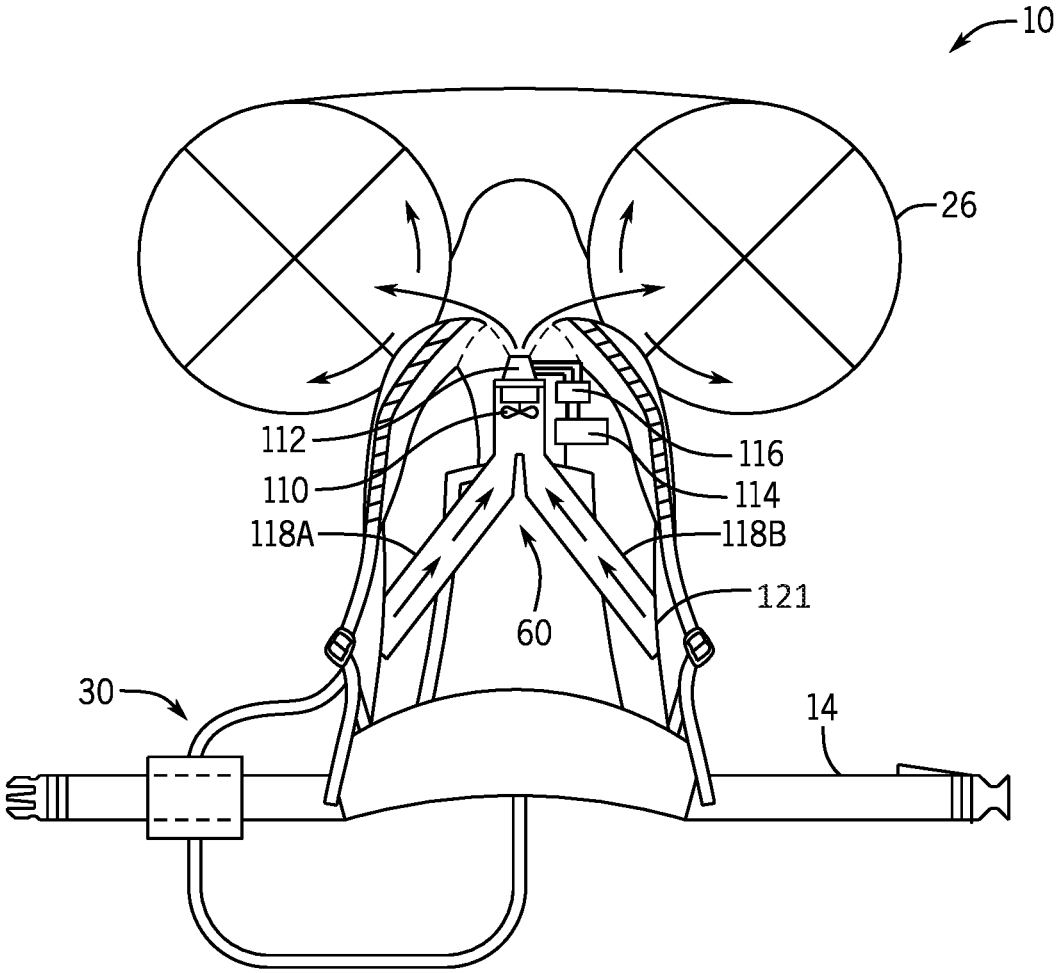
FIG. 14 is a front view of an airbag rescue system illustrating air flow into the airbag in accordance with another implementation of the present invention.

The conduit 118 provides an ambient air passageway for conducting air from the intake screen 121 to the intake of the air movement device 110. The air movement device 110 discharges or outputs the air to an opening at the airbag 26 for inflation. In another implementation as shown in FIG. 14, rather than a single conduit 118, a pair of such conduits 118A and 118B can be employed, each pulling in ambient air from a respective intake screen 121 on a respective one of the sides of the backpack. The conduit 118, 118A and 118B can be mounted on, or can be supported by, the intake screen 116. In one implementation, the conduit 118, 118A and 118B can be formed by an elongated compartment formed in the pack between the intake screen 121 and the air movement device 110.

The air movement device 110 can be an air mover, a fan, an air pump, or an air compressor, a ducted fan blower, a rotary or centrifugal fan/compressor, an axial fan/compressor (turbine), a rotary vane pump/blower/compressor, a gear pump, and a squirrel-cage blower/fan. All possibilities are within the scope of the invention. The air movement device 110 receives ambient air from the conduit, and directs, pushes and/or pumps the air through its output into the airbag 26 for inflating the airbag 26.

The air movement device 110 is sized and configured to achieve the objectives of the airbag system. In one implementation, the air movement device 110 and balloon inflation system is configured to fully inflate an airbag having a volume of at least 150 liters within a predetermined time period. In one particular implementation, the predetermined time period is five seconds or less. In other implementations, other sizes of airbags and other inflation time periods may be used.

The air movement device 110 is powered by the electric motor 112. In one particular implementation, the motor is an in-runner or out-runner brushless DC motor. In other implementations, other forms of AC and DC motors can be used. The motor converts electrical energy into mechanical energy driving the air movement device 110.

Figure 6:
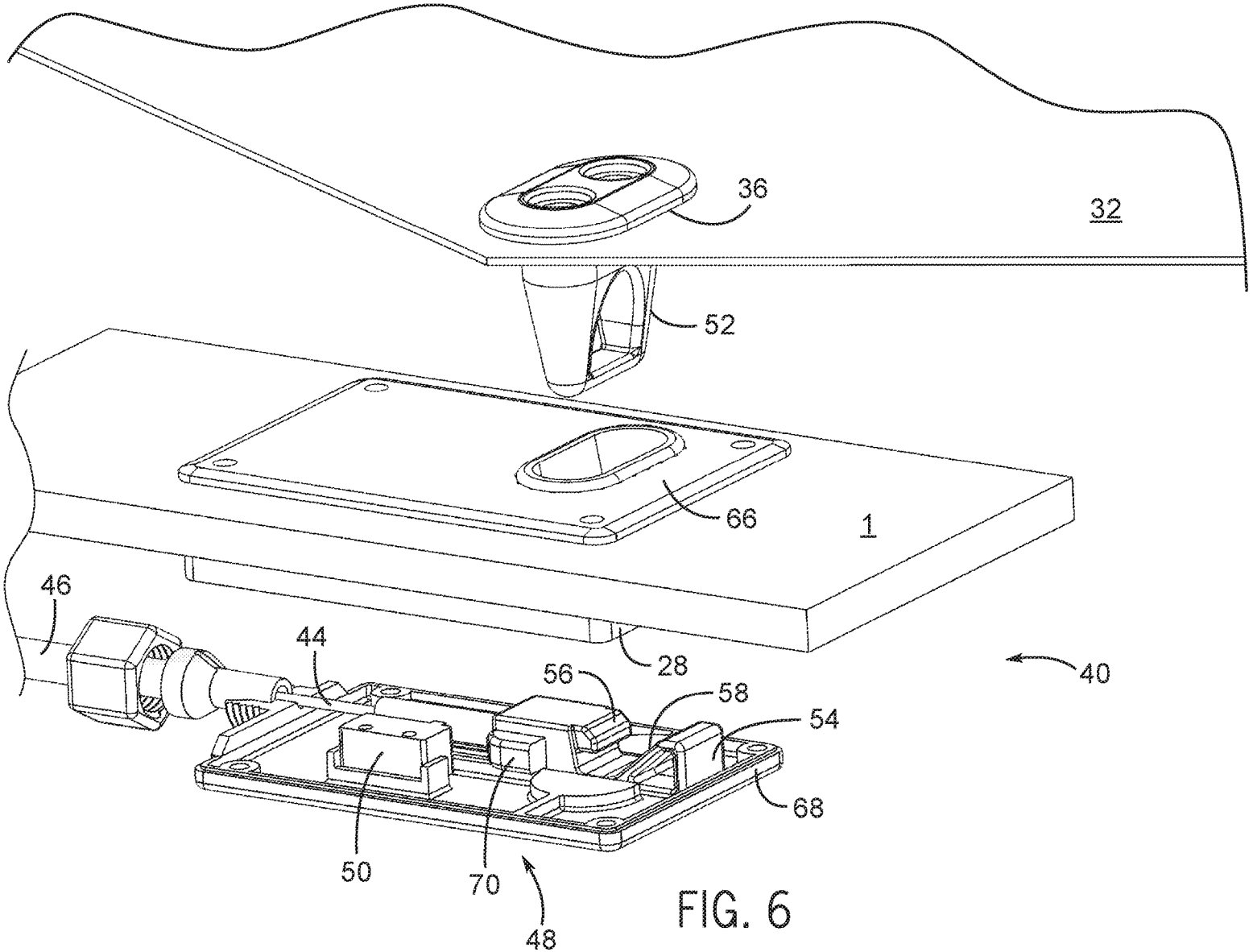
FIG. 6 is an exploded view of a latch mechanism and associated portions of the pack and a pack flap of the rescue system pack of FIG. 1.

The battery 114 is supported proximate the motor 112 and the air movement device 110. The battery 114 may be of a rechargeable lithium-ion polymer (LiPo) type. In other implementations, other types of batteries can be used. The controller 116 controls the operation of the balloon inflation system 60 and is operably coupled to the electrical switch 50 (FIG. 6).

Figure 15:
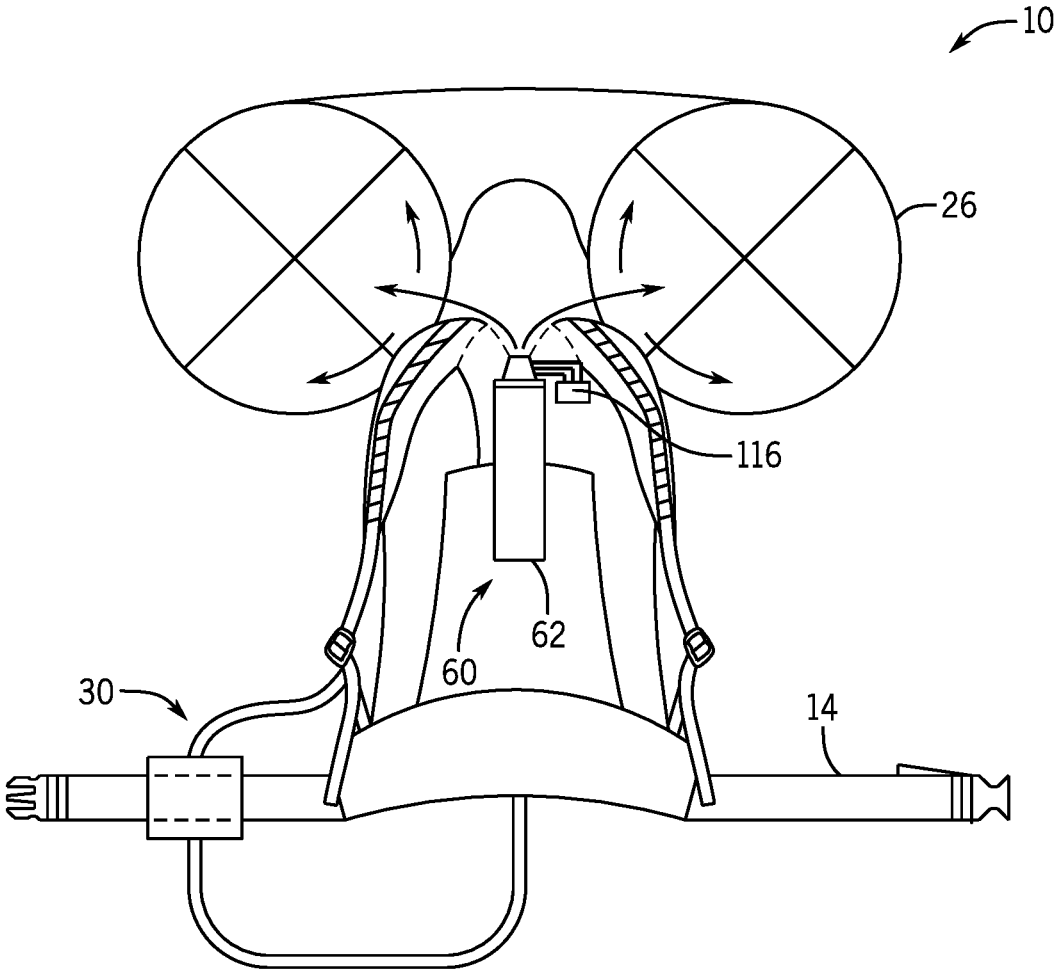
FIG. 15 is a front view of an airbag rescue system illustrating air flow into the airbag in accordance with another implementation of the present invention.
Figure 16:
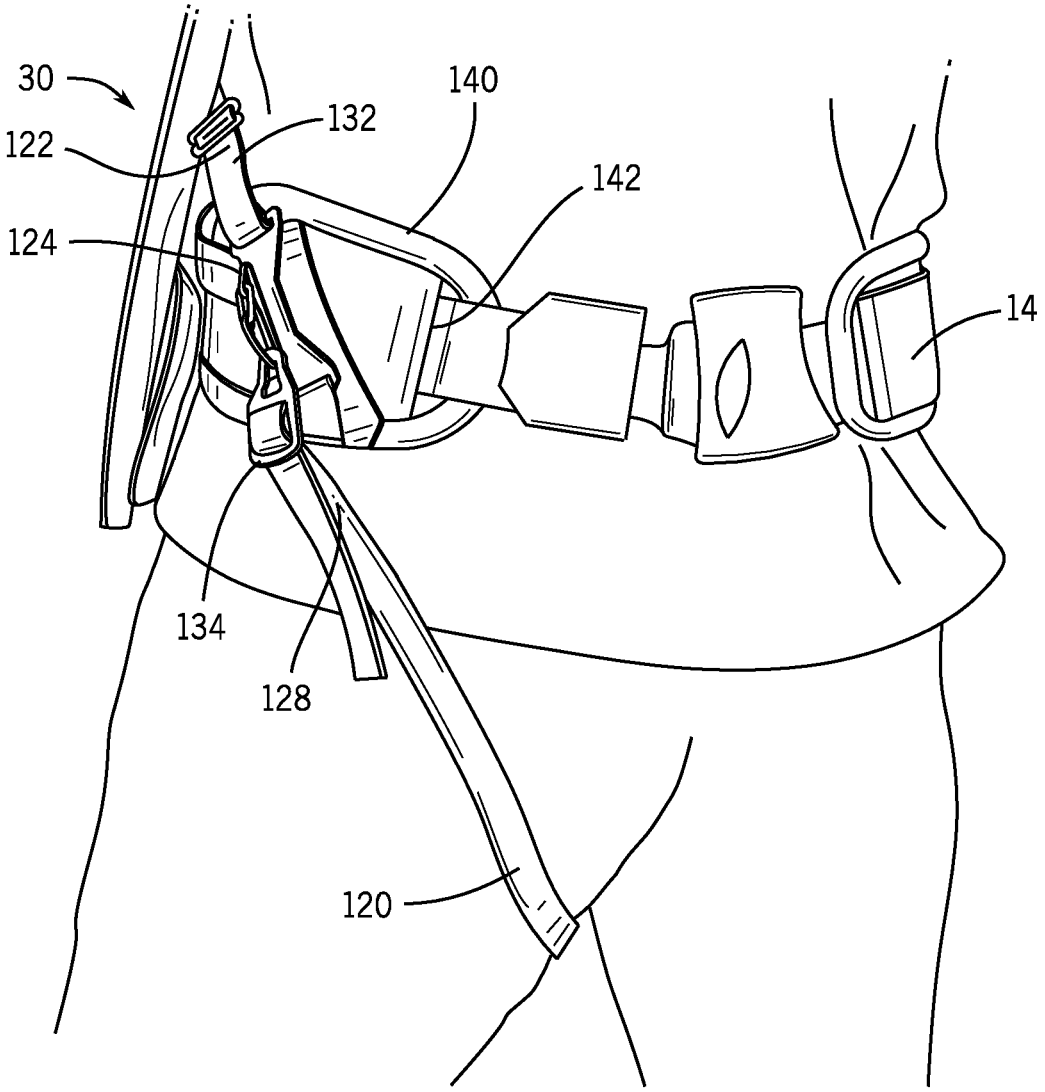
FIG. 16 is a front view a lower portion of the airbag rescue system of FIG. 1.
Figure 17:
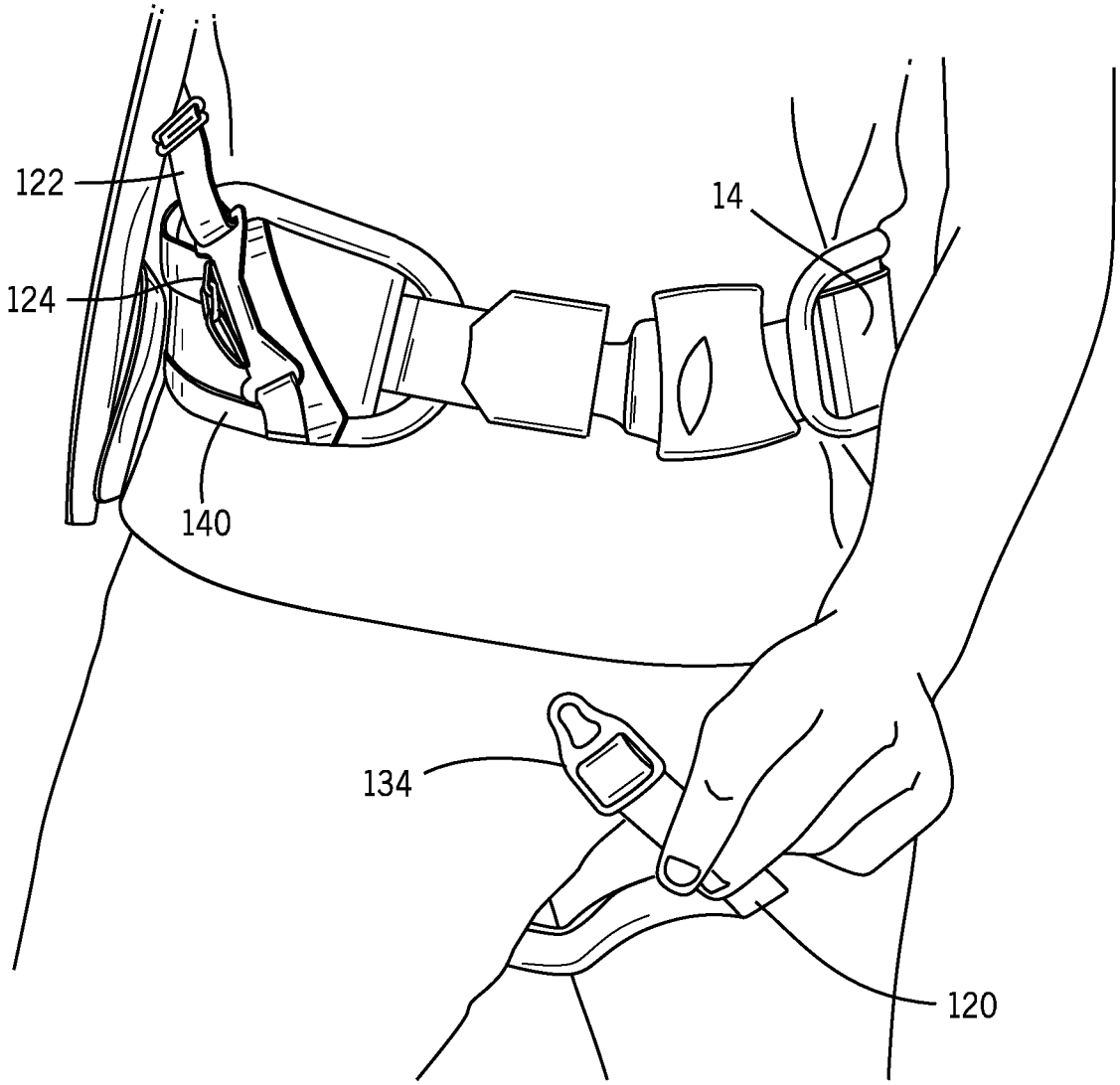
FIGS. 17 and 18 are front views a lower portion of the airbag rescue system of FIG. 16 illustrating the releasable connection of a leg strap to a leg strap fastener.
Figure 18:
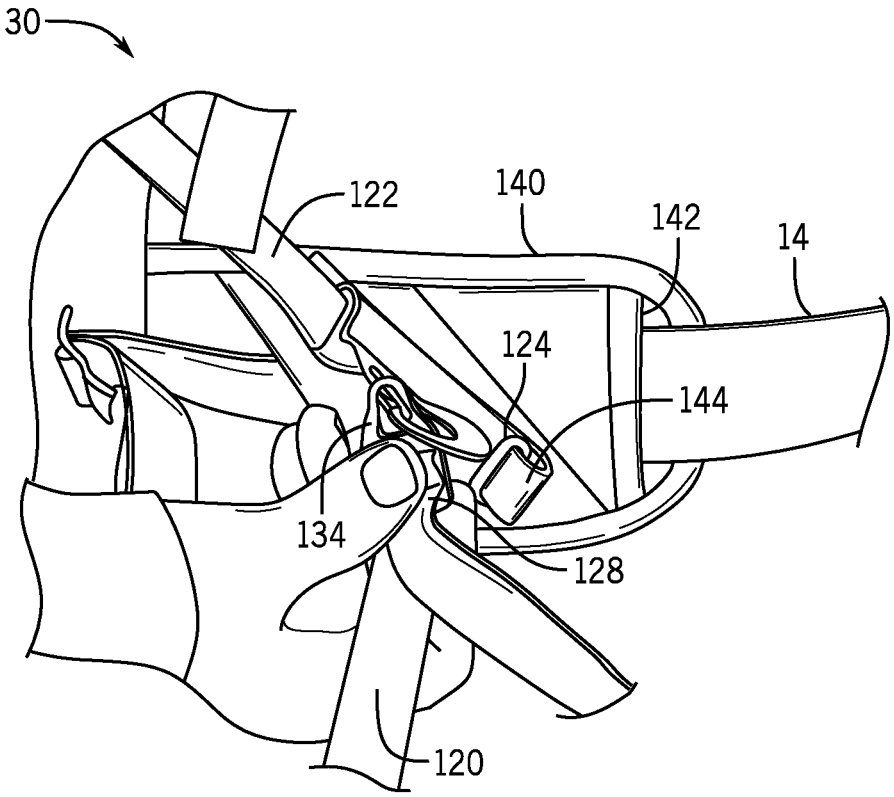
Figure 19:
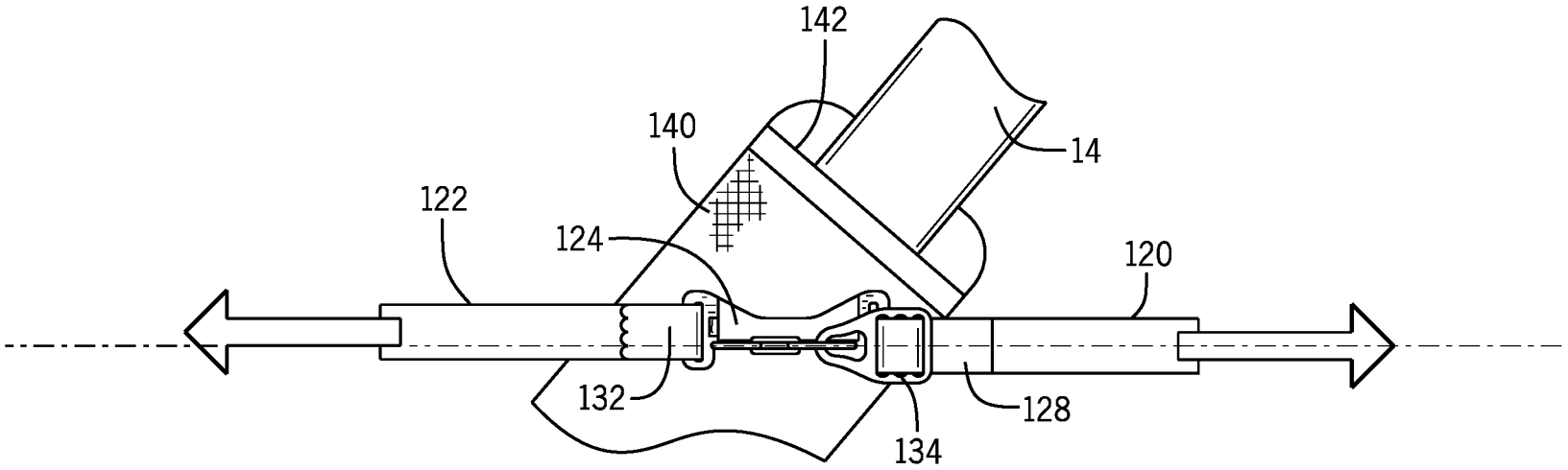
FIGS. 19 and 20 are top and side views of a leg strap assembly of FIG. 16.
Figure 20:
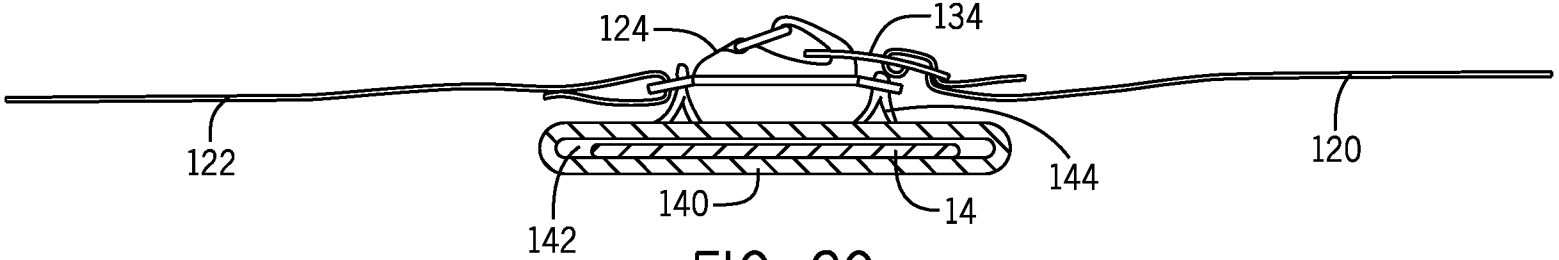

Referring to FIG. 15, another implementation of the present invention is illustrated. In lieu of an air movement 110, motor 112 and battery 114, the balloon inflation system 60 can utilize one or more canisters 62 including pressurized gas (e.g., nitrogen) or air. The controller 116 can be used to initiate release of the canister 62 upon actuation of the electrical switch 50. In another implementation, the controller can be eliminated and the electrical switch can release the gas canister 62.

Referring to FIGS. 12B and 16 through 20, the leg strap assembly 30 is shown in greater detail. The leg strap assembly 30 is configured for ease of use and adjustment, and to efficiently transfer lifting forces that can result from the deployment of the airbag 26 during use of the backpack 10. The leg strap assembly 30 prevents the backpack 10 from being pulled up and/or off of the user during use and deployment of the airbag 26. The leg strap assembly 30 includes a first leg strap 120, a second leg strap 122, and a leg strap fastener 124. The first and second leg straps 120 and 122 are formed of a high strength, flexible material, such as a structural webbing. In one implementation, each of the first and second leg straps 120 and 122 includes a element for adjusting the length of one or both of the straps 120 and 122. Such adjustability allows for the user to adjust the pack 10 to provide proper fitting to match a specific application. It allows for the adjustment over bulky clothes, for example.

A first end 126 of the first strap 120 is coupled to a lower region of the body 16 of the backpack 10. In one implementation, the first end 126 is coupled to the back support structure 100. A second end 128 of the first strap 120 is releasably connectable to the leg strap fastener 124. The first strap 120 is configured to extend from the lower region of the backpack 10 through the user's legs and then to the side of the user for releasable connection to the fastener 124. A first end of 130 of the second strap 122 is coupled to the backpack 10 and a second end 132 of the second strap 122 is coupled to the leg strap fastener 124. As shown in FIG. 12B, in one implementation, the second strap 122 connects to the support webbing 102 (or other support structure such as the back support structure 100). The support webbing 102 extends to the airbag 26 and is coupled to the body 16 of the backpack 10. Accordingly, the second strap 122 is directly coupled to the airbag 26 so as to provide a structural support for the airbag 26 and the backpack 10 upon deployment of the airbag 26. In other implementations, the second strap 122 can be coupled to the body 16 of the backpack 10 but not to the airbag.

In one implementation, the leg strap fastener 124 is a gated carabiner, and the second end 128 of the first strap 120 includes a ring 134 (such as a D-ring) to facilitate the releasable connection of the second end 128 of the first strap 120 to the gated carabiner 124. In one implementation, the leg strap fastener 124 is coupled to the waist belt 14 through a waist belt mount 140. The waist belt mount 140 can take the form of a sleeve having a waist belt passage 142 for receiving the waist belt 14. In one implementation, the waist belt mount 140 is advantageously positioned toward the left or right hip area of the user so as to route the first and second leg straps 120 and 122 toward the side of the user's leg as the first strap 120 extends forward from the lower region of the backpack 10 through the user's legs for releasable engagement with the fastener 124 at the right or left front-side or side of the user. The side positioning of the mount 140 facilitates the connection and disconnection of the first leg strap 120 to the leg strap fastener 124, and provides for a more comfortable positioning of the leg strap 120 through the legs of user. The ring 134 and the waist belt mount 140 allow for the first leg strap 120 to be easily, quickly and efficiently connected or disconnected to the leg strap fastener 124 by a single hand of the user. The leg strap 120 can be connected and/or disconnected to the leg strap fastener 124 without having to undo or disconnect the waist belt 14. Accordingly, the leg strap connection can be performed by the user with one hand without disturbing, and independent of, the waist belt 14. This configuration allows for the leg strap 120 to be easily undone at any time, independent of the other straps. The ability to quickly undo the leg strap 120 at any time enables the user to quicky rotate the backpack to their front for accessing compartments within or gear with the backpack, or for accessing ski lifts. Another advantage of the one-handed quick connection/disconnection of the leg strap 120 to the fastener 124 is that it enables a user who does not wish to use the leg strap assembly 30 to route the first leg strap 120 around his or her back to the side mount 140 and conveniently clip the ring 134 to the fastener 124. Such connection allows the user to avoid having the leg strap dangling below the backpack 10.

In one implementation, the leg strap fastener 124 is coupled to the waist belt mount 140 through a non-load bearing connection 144. The non-load bearing connection 144 can one or more resilient, expandable or releasable connectors that provide a level of stabilization to the leg strap fastener 124 during normal use of the backpack 10. In one particular implementation, the non-load bearing connection 144 can be a pair of highly resilient webbings that retain the fastener 124 to the mount 140 during normal use, but do not absorb the large loads applied to the pack 10 and the leg strap assembly 30 during deployment of the airbag 26. When the backpack 10 is actuated during use, the upward loads exerted onto the leg strap assembly 30 from the deployment and use of the airbag 26 are transmitted to the first and second leg strap 120 and 122 and the leg strap fastener 124 without transferring such loads to the waist belt mount 140 or to the waist belt 14. The non-load bearing connection 144 receives normal stabilization loads, but not the larger loads generated from operation and deployment of the airbag system. In this implementation, the large upward loads produced from the deployment and use of the airbag 26 are efficiently transferred to the leg strap assembly 30 through the support webbing 102 without relying on the waist belt mount 140 or the waist belt 14 for structural support. Only negligible loads are transferred to the waist belt mount 140 and the waist belt 14.

In other implementations, the first and second straps 120 and 122 can be replaced with a single strap or three or more straps. In another implementations, the leg strap fastener 124 can be a buckle or another form of fastener other than a gated carabiner. In another implementation, the waist mount can be connected to the waist belt in through a load bearing connection.

For manufacturing airbag rescue systems and triggering devices in particular, the use of various materials are within the scope of the invention and various manufacturing processes are within the scope of the invention, such as injection molding. Various components of the triggering device, such as the handle and the lock, as well as the base, for example, can be made of any of various synthetic polymers such as particular thermoplastics, including nylon and, more particularly, polyoxymethylene (POM), for example, the latter being self-lubricating and offers favorable characteristics for use in cold and wet conditions, has a low coefficient of friction, low water absorption, excellent dimensional stability, and high tensile strength, for example. In this regard, variations of components are embraced by the invention, such as making the base plate 15 and retaining flange 16 as one piece. Other components, such as cables, screws, nuts, etc. can be made of stainless steel or other materials that have characteristics that perform well in outdoor environments, particularly in wet and cold environments.

While the preferred embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A backpack for carrying by a user, the backpack comprising:

a body including a back support structure and at least a first enclosure defining at least a first compartment and a first opening for accessing the first compartment;

an inflatable balloon positioned within the first compartment;

a balloon inflation system coupled to the body and to the inflatable balloon;

an actuator operably coupled to the balloon inflation system;

a leg strap assembly including:

a leg strap fastener, a first leg strap having a first end coupled to the back support structure and a second end coupled to the leg strap fastener, and a second leg strap end having a first end coupled to the body and a second releasably connectable to the leg strap fastener, the back support structure coupled to the inflatable balloon such that upon inflation of the balloon, tensile force is applied to the back support structure and to the leg strap assembly, and a waist belt extending from a lower region of the body and including a waist belt fastener and a waist belt mount coupled to the waist belt and positioned adjacent to the left or right hip of the user, wherein the leg strap fastener is coupled to the waist belt mount through a non-load bearing connection, wherein during normal use of the backpack, the non-load bearing connection retains the leg strap fastener to the waist belt mount and receives normal stabilizing loads, and wherein upon actuation of the balloon inflation system, upward loads produced by the actuation of the balloon inflation system are collectively supported by the first and second straps and the leg strap fastener with only a negligible portion of the upward loads being transferred to the waist belt mount and to the waist belt.

2. The backpack of claim 1, wherein the non-load-bearing connection is selected from the group consisting of a resilient connection, a releasable connection, an extendable connection, and a combination thereof.

3. The backpack of claim 1, wherein, when the backpack is worn by the user with the waist belt extending around the waist of the user and the waist belt fastener connected, the second end of the second leg strap is configured for one-handed releasable connection to the leg strap fastener by the user without having to disconnect the waist belt fastener.

4. The backpack of claim 1, wherein the waist belt mount is a waist belt sleeve, and wherein the wait belt sleeve includes a waist belt passage for receiving the waist belt.

5. The backpack of claim 1, wherein the second leg strap is adjustable in length.

6. The backpack of claim 1, wherein the leg strap fastener is a gated carabiner.

7. The backpack of claim 6, wherein the second end of the second leg strap includes a ring for releasable attachment to the gated carabiner.

8. The backpack of claim 1, wherein the leg strap is configured to be removed from the leg strap fastener by a user wearing the backpack without requiring the user to unbuckle the waist belt.

9. The backpack of claim 4, wherein the leg strap assembly and the waist belt are independently adjustable by the user.

10. The backpack of claim 1, wherein the second leg strap is formed of a structural woven webbing.

11. The backpack of claim 1, wherein the back support structure includes a support webbing.

12. The backpack of claim 3, wherein the second leg strap is positionable between a first position, in which the second end of the second leg strap extends through the legs of the user and releasably engages the leg strap fastener, and a second position, in which the leg strap extends around the hip of the user and releasably engages the leg strap fastener.

13. A backpack for carrying by a user, the backpack comprising:

a body including a back support structure and at least a first enclosure defining at least a first compartment and a first opening for accessing the first compartment;

an inflatable balloon positioned within the first compartment;

a balloon inflation system coupled to the body and to the inflatable balloon;

a waist belt extending from a lower region of the body and including a waist belt fastener;

a waist belt mount coupled to the waist belt and positioned adjacent to the left or right hip of the user; and only one leg strap assembly extending around only one leg of the user such that the other leg of the user is free of the leg strap assembly, the only one leg strap assembly including:

a leg strap fastener coupled to the waist belt mount, a first leg strap having a first end coupled to the back support structure and a second end coupled to the leg strap fastener, and a second leg strap end having a first end coupled to the body and a second releasably connectable to the leg strap fastener, the backpack being devoid of any additional leg strap assemblies.

14. The backpack of claim 13, wherein the leg strap fastener is attached to the waist belt mount through a non-load-bearing connection, wherein during normal use of the backpack, the non-load bearing connection retains the leg strap fastener to the waist belt mount and receives normal stabilizing loads, and wherein upon actuation of the balloon inflation system, upward loads produced by the actuation of the balloon inflation system are collectively supported by the first and second straps and the leg strap fastener with only a negligible portion of the upward loads being transferred to the waist belt mount and to the waist belt.

15. The backpack of claim 13, wherein, when the backpack is worn by the user with the waist belt extending around the waist of the user and the waist belt fastener connected, the second end of the second leg strap is configured for one-handed releasable connection to the leg strap fastener by the user without having to disconnect the waist belt fastener.

16. The backpack of claim 13, wherein the waist belt mount is a waist belt sleeve, and wherein the wait belt sleeve includes a waist belt passage for receiving the waist belt.

17. The backpack of claim 13, wherein the second leg strap is adjustable in length.

18. The backpack of claim 13, wherein the back support structure is coupled to the inflatable balloon, and wherein upon inflation of the balloon, tensile force is applied to the support element and to the leg strap assembly.

* * * * *